US006081249A

United States Patent [19]

Harris

[11] Patent Number: 6,081,249

[45] Date of Patent: Jun. 27, 2000

[54] WRAP AROUND MEMBRANE COLOR DISPLAY DEVICE

[76] Inventor: Ellis D. Harris, 1646 Lynoak Dr., Claremont, Calif. 91711

[21] Appl. No.: 08/909,150

[22] Filed: Aug. 11, 1997

[51] Int. Cl.[7] ..... G09G 3/34

[52] U.S. Cl. ..... 345/85; 345/108; 359/230

[58] Field of Search ..... 345/85, 84, 31, 345/108, 206; 359/230, 233, 296, 292; 361/280, 281

[56] References Cited

U.S. PATENT DOCUMENTS

| | | | |
|---|---|---|---|
| 3,897,997 | 8/1975 | Kalt . | |
| 4,094,590 | 6/1978 | Kalt . | |
| 4,105,294 | 8/1978 | Peck . | |
| 4,160,582 | 7/1979 | Yssuo . | |
| 4,229,075 | 10/1980 | Udea et al. . | |
| 4,234,245 | 11/1980 | Toda et al. . | |
| 4,336,536 | 6/1982 | Kalt et al. . | |
| 4,468,663 | 8/1984 | Kalt . | |
| 4,747,670 | 5/1988 | Devio et al. . | |
| 4,831,371 | 5/1989 | Hata . | |
| 4,891,635 | 1/1990 | Hata . | |
| 4,958,150 | 9/1990 | Dabbaj | 345/108 |
| 5,638,084 | 6/1997 | Kalt | 345/85 |

FOREIGN PATENT DOCUMENTS

| | | | |
|---|---|---|---|
| 0438614 | 7/1991 | European Pat. Off. | 345/108 |
| 4012391 | 1/1992 | Japan | 345/85 |

*Primary Examiner*—Regina Liang

[57] ABSTRACT

A flat panel color display device is comprised of a two-dimensional array of stacks of colored membranes. Each membrane is comprised of a conductive film sandwiched between colored insulating films and integrated within a pellicle assembly which wends between pairs of adjacent colored fiber electrodes between which membrane stacks are juxtapositioned and around which membranes optionally wrap. Each colored membrane stack together with portions of the adjacent fiber electrodes defines one color pixel produced by the exposed surface colors of the membranes and the fiber electrodes. Any pixel or group of pixels of the display can display any color of the palette. Thin film transistor electronics are provided within a silicon coating on one fiber of each pair. Conductive traces on the pellicle assembly provide power, signal and interconnectivity between fiber electrodes and the pellicle assembly. Pixel color is established in accordance with input signal by supplying a voltage pattern to the membranes whereby they part revealing surfaces of a common color, membranes on either side of the part being repelled from each other and attracted together and to an adjacent fiber electrode. The display is neither self-luminous nor requires a dedicated light source but is viewable under ambient illumination. It's thin format enables picture-on-the-wall color television. In an optional configuration an included power source together with sample-and-hold electronics provides image storage following disconnection from signal and prime power. Reconnection to sources of power and synchronization allows recovery of the stored image as a data stream.

15 Claims, 15 Drawing Sheets

40

| 42 | | 44 | | 46 | 48 |
|---|---|---|---|---|---|
| 0 | | 1 0 1 0 1 0 1 | ⇔ | 1 | WHITE |
| 0 | | 1 0 1 0 1 0 ⇔ 0 | | 1 | YELLOW |
| 0 | | 1 0 1 0 1 ⇔ 1 0 | | 1 | MAGENTA |
| 0 | | 1 0 1 0 ⇔ 0 1 0 | | 1 | CYAN |
| 0 | | 1 0 1 ⇔ 1 0 1 0 | | 1 | BLUE |
| 0 | | 1 0 ⇔ 0 1 0 1 0 | | 1 | GREEN |
| 0 | | 1 ⇔ 1 0 1 0 1 0 | | 1 | RED |
| 0 | ⇔ | 0 1 0 1 0 1 0 | | 1 | BLACK |

LEGEND

0 FIRST POLARITY
1 SECOND POLARITY
⇔ FORCE OF REPULSION

FIGURE 2

FIGURE 5A
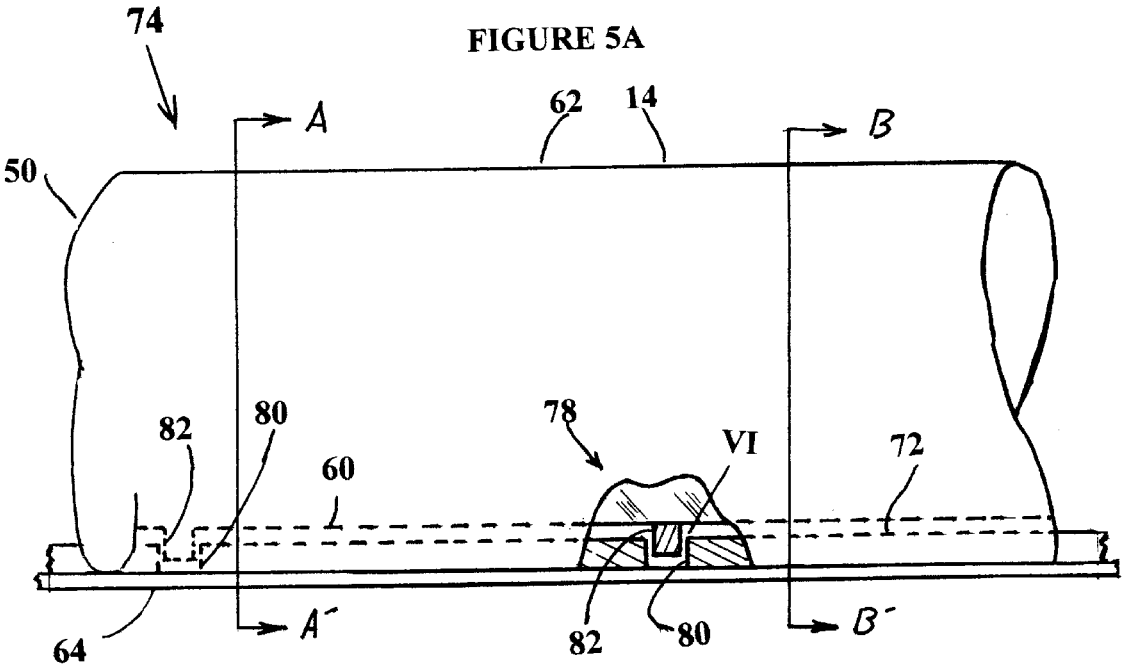
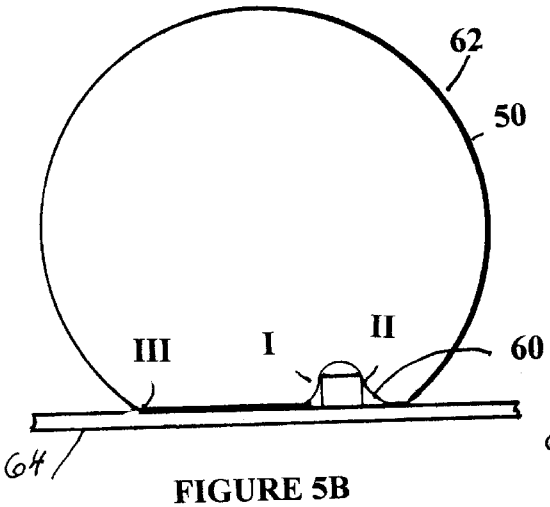
FIGURE 5B
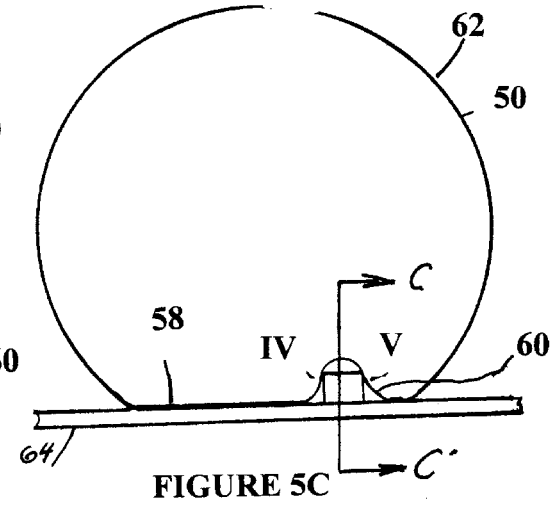
FIGURE 5C 50
154
14
62
130
132

130
150
118
146
142
118
138
134
136
118
140
132
152
144
118
130

WRAP AROUND MEMBRANE COLOR DISPLAY DEVICE

BACKGROUND OF THE INVENTION

This invention relates to a visual display device, and more particularly, to a flat panel electronic color display using stacks of voltage positionable colored membranes.

A visual electronic display device consists of optical, mechanical, and electronic parts in an assembly that accepts data in an electronic form and provides a visual display of the data to an observer. In current society visual electronic displays are ubiquitous, being a requirement of every television set, every computer, and many dedicated products. Early display devices were limited to Black and White or monochrome. As color became available it quickly became the technology of choice. Of particular importance are color displays which possess a color gamut capable of reproducing the many hues, chromas, brightnesses and saturations of natural objects, which perform at Television frame rates, and which address the needs of portable equipment, specifically in regards to battery power drain.

Electronic output display devices were popularized with the advent of Television, wherein images are typically presented at a rate of 30 frames per second to give an illusion of reality. While television was initially in black and white, the development of color technology has made color the preferred approach. More recently a variety of displays have been developed and are under development. In many prior art displays the generation of light by the display itself or the inclusion of a dedicated light source is the major power need, the major source of waste heat, and for portable equipment, the major battery drain.

This invention relates to utilizes and integrates a variety of technologies and disciplines, including:

Electrostatics:

While electrostatic phenomena were studied extensively during the earliest stages of electrical investigations, it has been the electrodynamic phenomena that have been dominant in the electrical industries. A notable exception has been the advent of xerography, in which electrostatic forces are employed in printing images on plain paper. Related disciplines have matured since the introduction of xerography in the 1950's. Both analytical and graphical methods for the analysis and mapping of electrostatic fields are well known and have been historically utilized in the analysis of electroscopes.

The utilization of electrostatic forces in conjunction with one or more stacks of colored, conductive, insulated, flexible membranes in a color display device as disclosed herein is a novel and an advantageous feature of the described invention.

Toner:

Technologies for the development and production of toners for monochrome and color Xerographic photocopy products are well established. Toner particles are fabricated as color pigments dispersed in a polymer. Particles range to as small as 0.04 micrometers diameter and utilize a variety of pigment colors. Color xerographic products routinely use Black, Cyan, Magenta and Yellow toners. Red Green and Blue toners have been developed for specialty products. Other developments have included magnetic toners, metallic toners and toners having specific brightness in ultraviolet and/or infrared wavelengths.

The utilization of either colored toner particles of color pigments imbedded within photo-resist materials whereby colored thin film patterns are obtained as described herein is novel and beneficial to the colored display herein described.

Color Science:

It has been demonstrated by prior art, in both xerography and offset printing that with black, cyan, magenta and yellow (CMY) dyes a full color palette is available. The additional colors of, red green and blue (RGB) can be made available either as separate toners or by dye-on-dye using the CMY toners.

The following color definitions are established:

BRIGHTNESS: Perceived quantity of visual flux

HUE: Visual sensation to which an area appears to be similar to one of a set of standard colors, or combinations of these.

SATURATION: The colorfulness of an area judged in proportion to its brightness.

CHROMA: Colorfulness of an area judged as a proportion to brightness of a similarly illuminated area that appears White.

GAMUT: The three-dimensional color space that encompasses all of the colors reproducible by the process.

PALETTE: Specific colors available within the gamut.

The human eye perceives color at a resolution significantly lower than its perception of brightness. If a display is configured to match brightness resolution to the capability of human vision then color of pixels is not resolved visually but will merge into intermediate values of hue and chrome As a result of this feature of human vision a very large number of hues and chromas can be made available from the eight basic primary colors at the same time high resolution in brightness, is achieved. Because of this, a large color palette is obtainable with just eight common primary colors Black, Red, Green, Blue, Cyan, Magenta, Yellow, and White (KRGBCMYW) in dot next to dot.

In self luminous displays, as for example a cathode ray tube, adequate color rendition can be achieved by employing Red, Green, and Blue patches in a localized group utilizing brightness control. In the case of reflective displays, however, the rendition of color highlights demand that patches in any localized group be of the same highlight color. Side-by-side patches of different reflective primary colors as needed to develop a specific hue and chroma are incapable of adequate rendition of the brightness of highlight colors of many objects in nature. The present inventive color display device allows any or all color patches in a localized group to exhibit the same color, enabling bright white, yellow, cyan and magenta colors and their combinations. Those colors of lesser brightness, i.e. Red, Green and Blue and their combinations are, of course, also enabled.

The capability for all pixels of any local area to be any of the bright primary colors, Cyan, Magenta, and Yellow, allows the display of highlight colors in maximum brightness, as contrasted to the limited brightness available when they must be developed as dot-next-to-dot using the darker primary colors, Red, Green and Blue.

Pellicles:

A pellicle is a very thin polymer, or plastic film or membrane used commonly as a beam splitting component in optics and often utilized as an optical protective cover. Commercial pellicle beam splitters are available with thicknesses from 2 micrometers to 8 micrometers and thicker. A typical substrate material is nitrocellulose and they are readily coated with a variety of metals or polymers. Any of several common polymers can serve the function of a pellicle. Thus, for example polyester (e.g. Mylar, a du Pont tradename) is available in thicknesses as thin as of the order of 2 microns, and is readily coated.

Patterned multi-layer coatings on a pellicle, including conductive traces for data transmission and voltage distribution means as well as interconnectivity means, as discussed herein relative to the inventive color display device are novel and enable beneficial features. The inclusion of mechanical features including flats, grooves, notches, ridges, and/or bumps for mechanical and electrical mating and alignment of a fiber electrode to a pellicle is novel herein and provides a beneficial feature of the presently described inventive device.

Fiber optics:

Both glass and polymer fibers are used extensively in the communication industry. Methods are well in hand for volume production of both multi-mode and single mode fibers. Single mode glass fibers typically exhibit the extremely precise characteristics required for single mode laser propagation. Glass fibers are commonly drawn at near molten temperatures from a glass preform. Fibers of various cross section profiles are producible by utilizing a preform that is a composite of two glass materials, one of which being relative soluble in a given solvent, while the other is highly insoluble. In the process of drawing, the fiber assumes a smooth round shape preserving the distribution of constituent glasses of the preform. A subsequent etching process removes the soluble glass, leaving the insoluble glass having the desired profile.

Fabrication of a glass fiber having a flat surface and a groove as described herein for mating and alignment is new and novel. The mechanical mating and alignment of a pattern on a glass fiber with a corresponding pattern on a pellicle is an inventive and beneficial feature of the herein-described invention.

Kinematic Assembly:

Is well known that six degrees of freedom are necessary and sufficient for locating a mechanical object in its three spatial positions and its three angular positions. This feature is the basis of all precision assembly, both mechanical and optical.

The mating and alignment of coating patterns on a glass fiber to corresponding coating patterns on a pellicle wherein kinematic alignment is achieved over each of a plurality of localized regions as described herein is a new and novel beneficial feature of the described invention.

Silicon Electronics:

Electronics is dominated by silicon technology, and comprises of a host of related and mutually supporting technologies, including materials, masks, resists, and echants. A variety of dopants are utilized to provide specific physical and electronic functions within the silicon. Electronic devices are most commonly generated in bulk silicon. However, electronic devices are also generated within silicon that has been grown by epitaxy upon an insulator, commonly, sapphire or glass. In the case of glass, silicon grown epitaxially on fused silica allows the as-grown silicon to be annealed at a temperature sufficiently high to result in polysilicon, which exhibits electronic properties superior to the as-gown silicon. Photoresist materials are commonly used and typically comprise a polymer to which optical sensitivity has been incorporated by an additive. In some materials the resist becomes insoluble under the influence of optical flux, while in other resists optical flux induces the resist to become soluble where unexposed resist remains relatively insoluble. Both types of photo resists are widely used in the electronics industry in patterning silicon and other substrates for subsequent development and etching.

The fabrication of thin film transistor electronics within a silicon coating on a glass fiber is novel and provides a beneficial feature of the invention and is further applicable to electronics in general. The inclusion of mechanical features within the coatings on a glass fiber is inventive and is an advantageous feature of the invention.

Display devices based upon electrostatic attraction of a thin, insulated dielectric membrane have been disclosed in a number of prior art patents, including: U.S. Pat. Nos. 3,897,997; 4,094,590; 4,105,294; 4,160,582; 4,229,075; 4,336,536; 4,468,663; 4,747,670; 4,831,371; 4,891,635; and 5,667,784. Without exception these provide a monochrome display and fail to provide for color.

Printing and display technologies have invariably emerged as monochromic. Color technology has subsequently followed. When color has been available it has been preferred, both for esthetic reasons and for the additional information which can be displayed. The present inventive display device provides this important beneficial feature of color that is lacking in the above referenced prior art.

A prior art color display device is disclosed in U.S. Pat. No. 5,638,084. In '084 the color is provided by color pixels which are necessarily either black or of a single color. Any single pixel of the display cannot exhibit a selection of color. The color palette must be achieved by side-by-side patches that are each of a single color or are black. The unavoidable result is that color highlights are not available. In '084 optical paths to colored patches can optionally be covered with a black shutter or uncovered. A typical four-patch group (FIG. 2 of '084) comprises Red, Green, Blue and White patches. Black can be displayed for any of these by covering the patch with a shutter. A pure color of Red, Green or Blue is achieved by uncovering one patch of the four-patch group, leaving the other three patches black. However, maximum brightness is limited to one-quarter of what it would be if all four patches of the group showed the pure color. In the generation of the pure highlight colors of Cyan, Magenta and Yellow two color patches of the four patch RBGW group are uncovered leaving two patches showing black. The two uncovered patches together provide the brightness of a single patch of the pure highlight color. Again maximum brightness is only one-quarter of what it would be if all four patches of the group showed the pure color. In '084 White is achieved by uncovering the one White patch of the four-patch group and all three of the color patches. The brightness of the three uncovered color patches, taken together, is equivalent to that of a single white patch. The resultant brightness is only half of that available if all four patches were white. As a result the brightness of displayable White is limited to a shade of gray. Because of the above limitations inherent in '084 brightnesses, chromas, hues, and saturations of many natural objects in ambient illumination cannot be faithfully reproduced.

Prior art color displays that are self-luminous are typically brightness limited and cannot provide adequate luminance under bright ambient conditions, such as bright sunlight. The present inventive color display is functional under any bright ambient condition. In outdoor use it will emulate the brightness of a sign or a billboard in bright sunlight. As in any reflective display, as for instance a book, external illumination must be provided.

The ability of any color pixel or patch to show any of the colors of the color primary color palette is an advantageous feature of the present inventive color display. Chromas, hues brightnesses and saturations of natural objects in ambient illumination are faithfully reproducible for viewing in ambient illumination.

It is an object of this invention to provide a color display device using an assembly of stacks of voltage positionable colored membranes whereby each pixel color is selectable from a a palette of primary colors and wherein all pixels of the display are, optionally, able to assume any color of the primary color palette.

It is a further object of this invention to provide a color display device wherein the color highlights of natural objects in ambient illumination can be displayed.

It is another object of this invention to provide a high resolution, high brightness color display device wherein neither display self-brightness nor a dedicated illumination source is required, but wherein ambient illumination is utilized to view the display.

It is yet another object of this invention to provide a color display device upon which imaginal data is displayable at frame rates compatible with typical television and/or computer displays.

It is an additional object of this invention to provide a color display that is viewable in high ambient light conditions, such as bright sunlight.

It is yet another object of this invention to provide a non-self-luminous color display where by battery requirements for portable equipments are minimal.

It is a further object of this invention to provide a color display device in thin format wherein a printed page is emulated.

It is an additional object of this invention to enable "Picture on the Wall" television.

It is yet another object of this invention to provide a color display device that maintains the display of a color image when the display device is disconnected from sources of power.

It is a further object of this invention to allow a stored image display to be recovered as a data stream by reconnecting the display device to sources of power and synchronization.

Other objects and attainments, together with a fuller understanding of the invention will become apparent and appreciated by referring to the following description and claims taken in conjunction with the accompanying drawings.

SUMMARY OF THE INVENTION

A flat panel color display device is comprised of a two-dimensional array of stacks of colored membranes. Each membrane is comprised of a conductive film sandwiched between colored insulating films and integrated within a pellicle assembly which wends between pairs of adjacent colored fiber electrodes between which said membrane stacks are juxtapositioned and around which membranes optionally wrap. Each colored membrane stack together with portions of the adjacent fiber electrodes defines one pixel color, the color being produced by exposed surface colors of the membranes and the fiber electrodes. Any pixel or group of pixels of the display can display any color of the palette. Thin film transistor electronics are provided within a silicon coating on one fiber of each pair. Conductive traces on the pellicle assembly provide power, signal and interconnectivity between fiber electrodes and the pellicle assembly. Pixel color is established in accordance with input signal by supplying a voltage pattern to the membranes whereby they part revealing surfaces of a common color, membranes on either side of the part being repelled from each other and attracted together and to an adjacent fiber electrode. The display is neither self-luminous nor requires a dedicated light source but is viewable under ambient illumination. It's thin format enables picture-on-the-wall color television. In an optional configuration an included power source together with sample-and-hold electronics provides image storage following disconnection from signal and prime power. Reconnection to sources of power and synchronization allows recovery of the stored image as a data stream.

The low inertia of the moving membranes, coupled with the low power needed to set the membrane positions allows the speed of the display to be compatible with common television frame rates. Equipment portability is enhanced as a direct result of the low power requirement. The utilization of ambient illumination for viewing the display provides for low power consumption and hence reduced battery power needs for portable applications. Ambient light viewing also provides high brightness when viewed under high ambient brightness conditions, such as daylight or bright sunlight. Individual pixels are set to correspond with pixels in an input data stream in accordance with a scan pattern. The voltage to which any membrane of a membrane stack is set can be of either polarity. When disconnected from the data stream pixels are isolated electrically and the membrane voltages are maintained by circuit capacitance and/or sample-and-hold electronics.

BRIEF DESCRIPTION OF THE DRAWINGS

FIG. 2 presents voltage polarities on seven colored membranes and two adjacent fiber electrodes illustrating primary colors to which any given pixel is adjustable.

FIGS. 5A, 5B, and 5C illustrate kinematic alignment of a patterned glass fiber electrode to patterned coatings on a pellicle.

DESCRIPTION OF THE PREFERRED EMBODIMENT

Figure 1:
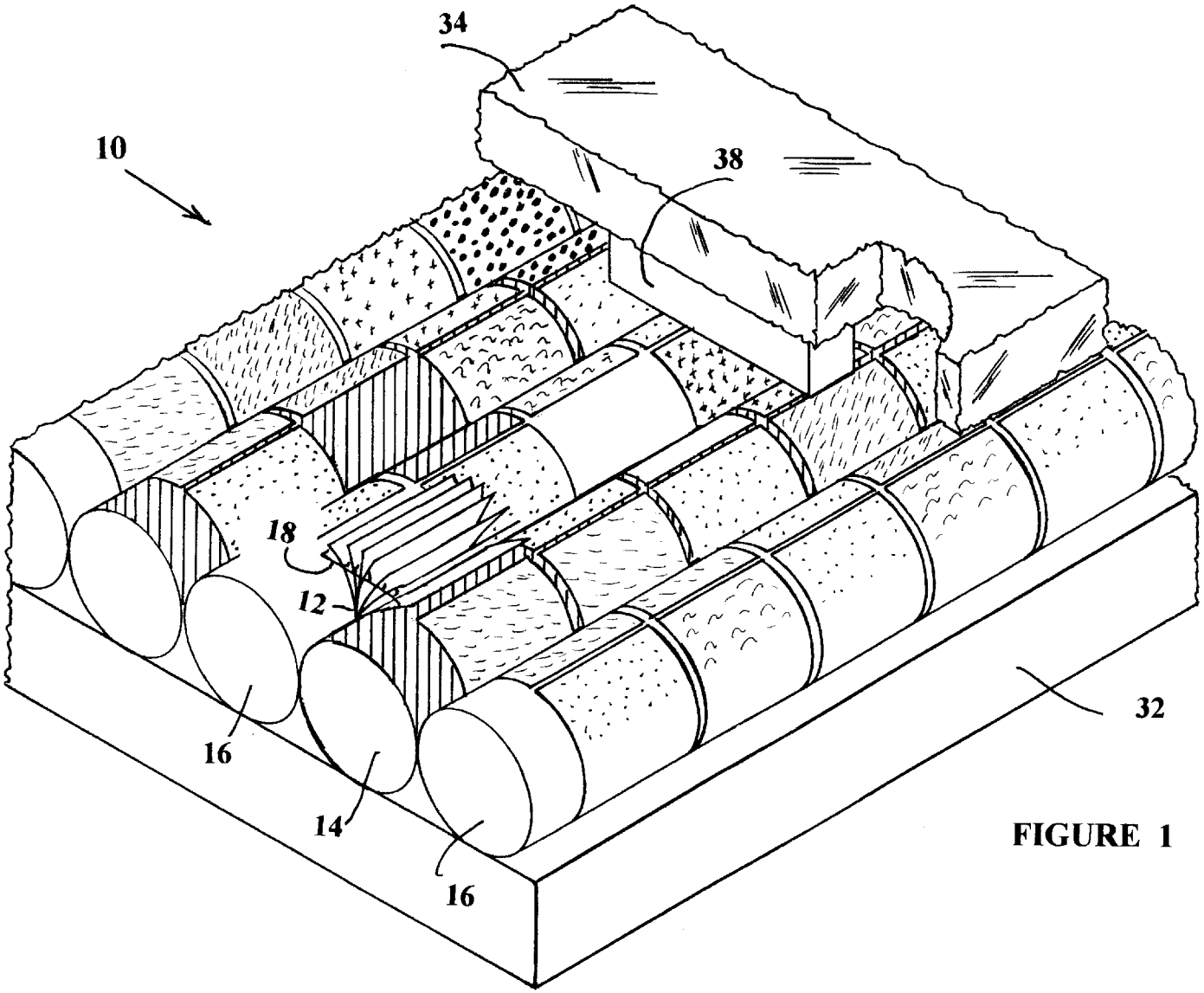
FIG. 1 is an isometric drawing illustrating a color display device fabricated according to the invention.

Reference is now made to FIG. 1 wherein is illustrated an isometric drawing of a color display device 10 incorporating the present invention. FIG. 1 will be discussed in conjunction with an example of a color display device employing the eight primary colors: Black, Red, Green, Blue, Cyan, Magenta, Yellow and White (KRGBCMYW). In the preferred embodiment the color display device 10 emulates a colored printed page. Also in the preferred embodiment the frame rate emulates that of television or computer monitors. Picture on the wall television is enabled and the portability of equipments that employ electronic displays is greatly enhanced by the inventive display herein described.

The color display devise 10 of FIG. 1 is comprised of a two dimensional array of stacks 12 comprising a plurality of colored flexible membranes 18 juxtapositioned and anchored between a plurality of fiber electrode pairs 14 and 16 of alternating color. In the preferred embodiment the colors of each electrode pair are taken as black and white. Each stack 12 of membranes 18 of the array defines one colored pixel of the display device 10. Each of the plurality of membranes 18 of a stack 12 includes an electrical conducting member. Insulation is provided to prevent electrical contact between membranes 18 and any other membrane 18 and/or an adjacent fiber electrode 14 or 16. The two surfaces of each of the plurality of membranes 18 of a membrane stack 12 are of a different color and the colors arranged whereby surfaces that face each other are of a common color. The surface of the membrane 18 nearest to an adjacent fiber electrode 14 or 16 and which faces that fiber electrode is of the same color as that fiber electrode. That surface portion of the fibers 14 and 16 around which membranes 18 might optionally wrap are conductive and insulative means are provided to prevent electrical contact between a membrane 18 and a fiber electrode. The black fiber 14 is charged electrically at one polarity and the white fiber 16 is charged to the other polarity. Signal voltages are supplied to a conducting member of individual membranes 18 of a membrane stack 12 by connection means, not shown. These signal voltages are provided in a pattern whereby only a single pair of adjacent surfaces of either fiber electrodes 14 and 16 and/or membranes 18 are of a common polarity and hence are electrically repelled. All other adjacent surfaces are of dissimilar polarities and thus are attracted. The flexible membranes 18 of a stack 12 separate at the surface pair of common polarity. Membranes 18 on either side of the separation are attracted to each other and to the nearest fiber electrode, the black fiber electrode 14 on one side or the white fiber electrode 16 on the other side. The separated surfaces are observable to an observer, are of a common color, and produce color for a given pixel. In the preferred embodiment the length of membranes 18 and membrane stacks 12 along the fiber electrodes 14 and 16 comprise the pixel length. Those portions of a fiber electrode pair 14 and 16 about which membranes 18 of a given stack of membranes 12 optionally wrap determine pixel width. The observable color of the pixel is the color of the two surfaces that are separated by electrical forces of repulsion.

In an illustrative example of a color display device employing the eight primary colors, KRGBCMYW, each color pixel is comprised of a portion of each of the two adjacent fibers 14 and 16, along with a given stack 12 of seven membranes 18 separated at surfaces of common color. Illustratively, the surface of membrane 18 facing the black fiber electrode 14 is black. The facing surfaces of the first membrane 18 and of the second membrane 18 are commonly Red. The facing surfaces of the second membrane 18 and of the third membrane 18 are commonly Green. The facing surfaces of the third membrane 18 and of the fourth membrane 18 are commonly Blue. The facing surfaces of the fourth membrane 18 and of the fifth membrane 18 are commonly Cyan. The facing surfaces of the fifth membrane 18 and of the sixth membrane 18 are commonly Magenta. The facing surfaces of the sixth membrane 18 and of the seventh membrane 18 are commonly Yellow. The surface of the seventh membrane, which faces the white fiber electrode, is white. Various pixel shadings in FIG. 1 illustrate the six colors plus Black and White. From these eight primary colors in adjacent pixels localized pixel groups as viewed by an observer can display a wide range of hues, chromas saturations and brightnesses.

When signal voltage polarities representing a given color for a pixel have established the color of the pixel and are then disconnected the membranes 18 become electrically isolated. Circuit capacitances hold voltage levels whereby the selected pixel color is maintained until the pixel is re-addressed. By this means pixel color is maintained throughout a scan frame. In an alternate preferred embodiment electronic auxiliary sample-and-hold circuitry is included allowing the display device to be removed from the source of signal and the displayed image maintained.

Along with the membrane stacks 12 and electrodes 14 and 16, the inventive color display device is further comprised of a lower enclosure 32 to which the fiber electrodes 14 and 16 are attached and an upper transparent closure 34 through which the display is viewed. The upper closure 34 includes stand off means 38 by which the top closure 34 is spaced sufficiently from the array of membrane stacks 12 to allow freedom of motion of the membranes 18 as they flex and wrap around the fiber electrodes 14 and 16 under the influence of electric fields. Stand off blocks 38 unavoidably destroy the few pixels they contact. However these blocks 38 are widely spaced over the pixel array in a pseudo random arrangement having no apparent pattern and destroy only a small percentage of the pixels. It has been observed in laser printers that a small percentage of pixels can be removed without materially affecting copy quality. The inclusion of the stand off blocks 38 provide a means to attach the top closure 34 to the colored display device 10 to achieve structural integrity with a minimum adverse impact.

Forces available to bend a flexible membrane, any of the membranes 18, to wrap, at least partially, around a fiber electrode, 14 or 16, can be determined by known methods of electric field mapping along with membrane material characteristic and the magnitude of voltage gradients which can be sustained.

Analysis indicates that the unit bending moment M, (per unit width of the membrane) due to the electric field between the said membrane and an adjacent fiber electrode is proportional to the square of the applied voltage, V, the electrical permittivity, e, and a constant, K, which is obtained from a field map and is a function of the geometry. According to analysis the relationship is expressed by equation (1):

$$M=V^2\,eK \qquad \text{Equation (1)}$$

The voltage, V, is the voltage difference between the membranes 18 and each other and/or an adjacent fiber electrode 14 or 16. The constant K is dimensionless and can be determined from a field map of the electric fields. In a typical case the value of K has been evaluated to be K=33. The permittivity e is that of air, $8.85\times10^{-12}$ Farad/Meter.

The unit bending moment, M, actually within any flexible membrane any membrane 18 when curved from a plane into a radius can be evaluated from radius of curvature, R, modulus of elasticity of the membrane material, E, and membrane thickness, t, according to equation (2):

$$M = \frac{Et^3}{12R} \quad \text{Equation (2)}$$

Thickness, t, of a maximally thick membrane 18 which can just be curved into a given radius of curvature R is obtained by equating the unit bending moments of equations (1) and (2):

$$\frac{Et^3}{12R} = V^2 eK \quad \text{Equation (3)}$$

Maximum acceptable thickness for a membrane 18 for given conditions is a primary design constraint. This thickness can be determined by evaluating Equation (3) for thickness t, yielding equation (4):

$$t = \sqrt[3]{\frac{12RV^2 eK}{E}} \quad \text{Equation (4)}$$

A physical limitation is the voltage gradient that can be sustained by the dielectric materials utilized. An experimental data point is available from Kalt 3,897,997 wherein a prior art device employing 0.25 inch diameter (R=3.175 mm) electrodes, insulated with about 0.00025 inch (t=6.35 icron) of polyvinylidene operated reliably at 35 volts, for a voltage gradient V/t within the insulation of about 140,000 Volt/Inch. By rearranging equation (3) it is seen that holding the voltage gradient V/t within a safe fixed value implies that the applied voltage V will vary directly with the fiber electrode radius, R.

$$V/R = 12\ e\ KV^3/Et^3 \quad \text{Equation (5)}$$

It is thus seen from Equation (5) that when the ratio of V to t is fixed at the maximum allowed for a given dielectric, then the ratio of V to R is also fixed.

Extrapolating this data to 3.0 Volt operation yields, as an example, a color display device having the following characteristics:

| | |
|---|---|
| Operating Voltage: | ±3 Volts |
| Fiber Electrode Diameter (2R) | 0.544 Millimeters |
| Membrane Insulation thickness | 0.544 Microns. |

This sample color display device will result in a pixel density display brightness resolution of about 46.7 lines (and pixels) per inch. Acceptable color resolution can be less. The greater the number of pixels within a resolvable area the greater the hues, chromas and brightnesses which are available. This is achieved at no cost color resolution as seen by an observer. At this pixel density a display of 640×480 pixels would provide a display size of 17×13 Inch.

FIG. 2 presents a table 40 which shows voltage polarities of two adjacent fiber electrodes 14 and 16 along with the polarities of signal voltage patterns on the membranes 18 of a membrane stack 12 along with colors selected by these voltage patterns. A first column 42 illustrates the fixed voltage polarity of the Black fiber electrode 14. The second column 44 presents voltage polarity patterns of, illustratively, seven membranes 18 that establish eight colors of the pixel. The third column 46 illustrates the fixed polarity on the White fiber electrode 16 that is opposite the fixed polarity of the Black fiber electrode 14. Finally the last column 48 shows the pixel color for signal voltage patterns for the eight colors KRGBCMYW.

Figure 3:
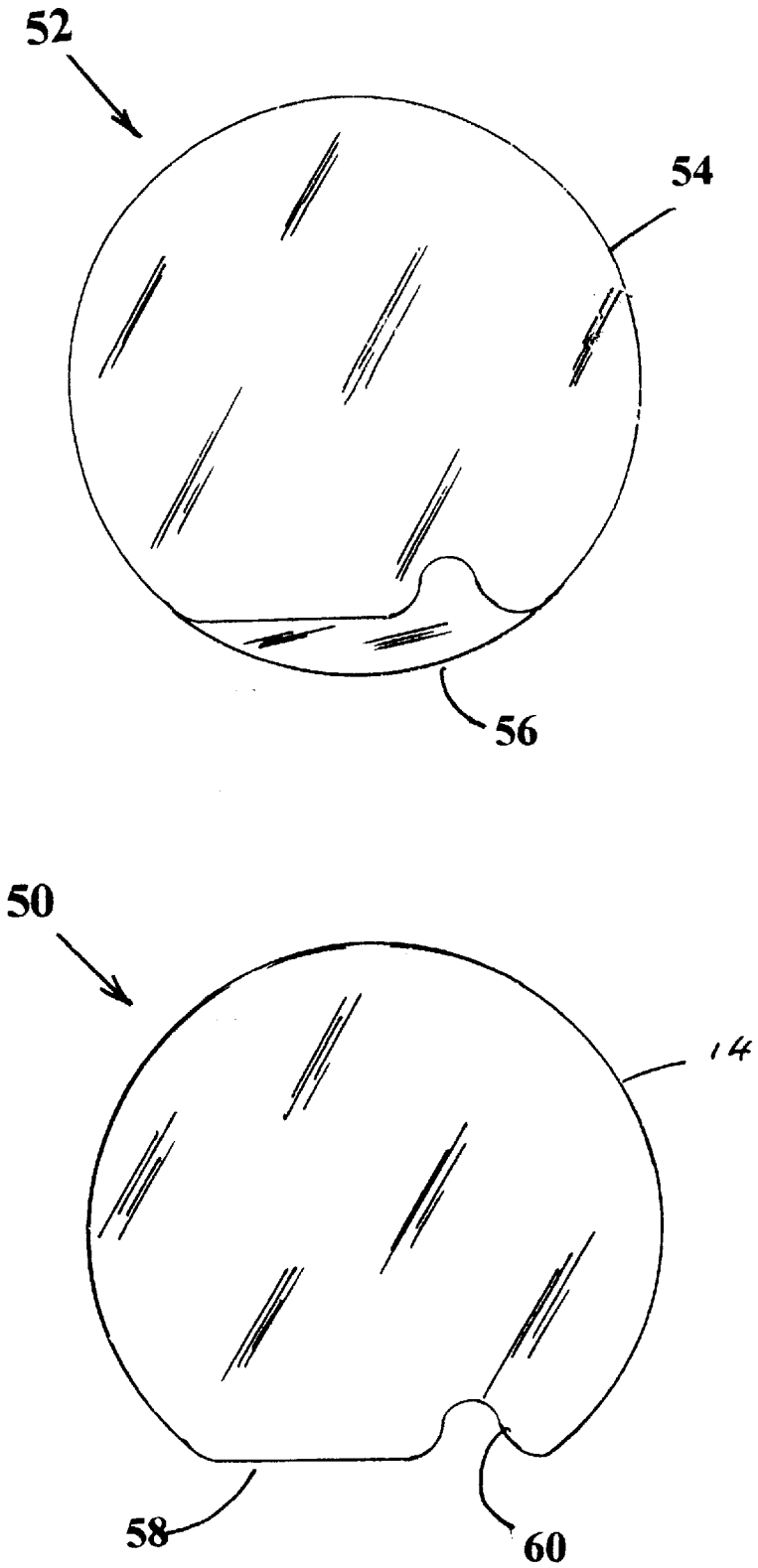
FIG. 3 illustrates the cross section of a glass fiber which is applicable to the preferred embodiment of the invention, including the preform from which it is pulled.

FIG. 3 presents a preferred cross-section 50 for one of the fiber electrodes of the pair. In the illustrative example this is the cross section of the black fiber electrode 14. Also illustrated is the cross section 52 of the glass preform from which the fiber is pulled. This preform 52 is comprised of a pair of component glasses. The first glass component 54 is, illustratively, comprised of fused silica or quartz glass or other glass that is very hard and relatively inert chemically. The second glass component 56 is comprised of a soft relatively soluble glass. Upon pulling into a fiber from a near molten state the resulting small diameter fiber preserves the cross section of the preform. The soft, relatively soluble glass component 56 is then removed chemically leaving a fiber of the desired glass material and of the desired cross section 50 for the black fiber electrode 14. This desired cross section includes a flat section 58 and a groove 60 for alignment and orientation and which run the entire length of the fiber.

Figure 4:
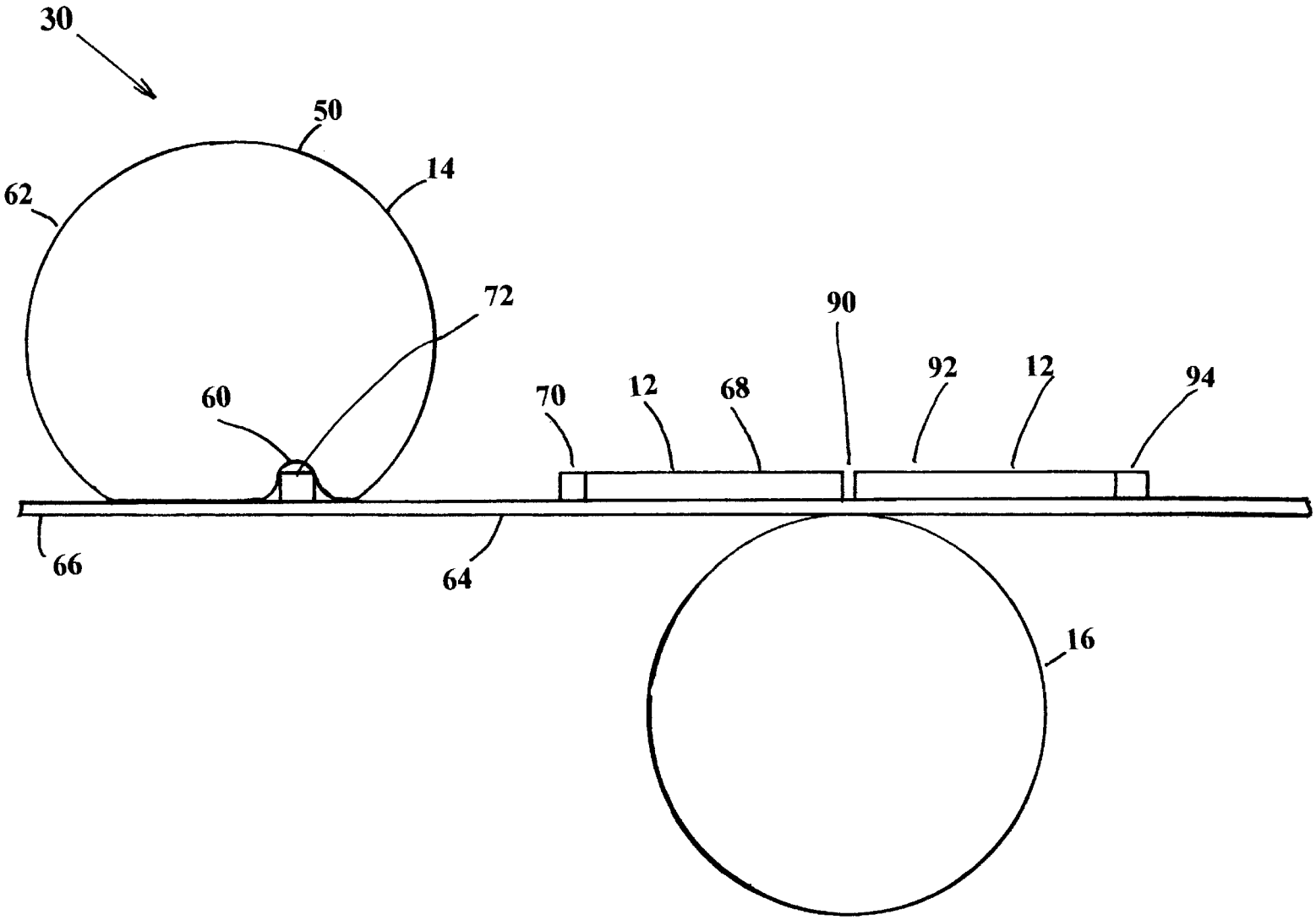
FIG. 4 presents an intermediate step in the production of the preferred embodiment of a display device made in accordance with the invention wherein a coated pellicle is illustrated positioned between alternate fiber electrodes.

Illustrated in FIG. 4 is a sub assembly 30 showing an intermediate step in the fabrication of a color display device 10 constructed in accordance with the present invention. FIG. 4 presents a two pixel sample of the mating of the plurality of membrane stacks 12 to black and white fiber electrode pair, 14 and 16, of the display device of the invention. A black fiber assembly 62 is mated mechanically and electrically to pellicle assembly 64. Pellicle assembly 64 is comprised of a pellicle substrate 66 coated with multi layer, patterned thin conducting and/or insulating films. These patterned thin films include: a multi level forerunner 68 of the stack of colored membranes 12; a connector/anchor 70 by which the flexible membranes 18 are attached along one edge to the pellicle 66 and by means of which electrical connectivity is established; and an alignment ridge 72 which mates with the alignment groove 60 in the black fiber assembly 62. The illustrated subassembly 30 represents a repeating unit in both directions. Sub assembly 30 includes the forerunner 68 of a membrane stack 12 for a single pixel along with its associated connector/anchor 70. Shown as well is the forerunner 92 for an adjacent stack 12 of membranes 18, together with its associated connector/anchor 94, being mirror images of the forerunner 68 and its connector/anchor 70 respectively. Also shown in FIG. 4 is a white fiber electrode 16 on the opposite side of the pellicle assembly 64, illustrating the mating of these fiber electrodes to the membrane assembly 64.

FIGS. 5A, 5B, and 5C illustrate the kinematic relationship 74 of the black fiber assembly 62 with the membrane assembly 64 whereby orientation and alignment is established. In the patterning of the black fiber electrode substrate 50 a plurality of alignment bumps 82 has been established at intervals within the alignment groove 60 which runs the length of each of the plurality of black fiber electrodes substrates 50. In the patterning of the membrane assembly 64 an alignment ridge 72 including a notch 80 has been produced at intervals. Orientation and alignment of a black fiber electrode assembly 62 with the membrane assembly 64 is achieved by mating the alignment ridge 72 and its plurality of notches 80 on the membrane assembly 64 with the alignment groove 60 and its plurality of bumps 82 and, by mating the flat 58 on the black fiber electrode assembly 62 with a corresponding flat region on the membrane assembly 64. When thus integrated the plurality of black fiber electrode assemblies 62 are aligned with the membrane assembly 64 in the necessary and sufficient six kinematic degrees of freedom at intervals over the display device 10. Points of contact whereby kinematic design is achieved are indicated by Roman numerals I through VI. In achieving alignment the relatively non elastic glass of the black fiber 14 is mated to the more elastic membrane assembly 64 by adjusting longitudinal tension in the membrane assembly whereby strain in the membrane assembly 64 is adjusted assuring mating of notches 80 with bumps 82. Similarly, strain adjustment in the orthogonal direction enables spacing control of fiber electrodes 14 and 16 over the extent of the display device 10 in that direction.

FIG. 5B shows the cross-section labeled AA'. FIG. 5C illustrates the cross-section labeled BB'. The cutout portion 78 in FIG. 5A illustrates the cross-section labeled CC' in FIG. 5B.

Figure 6:
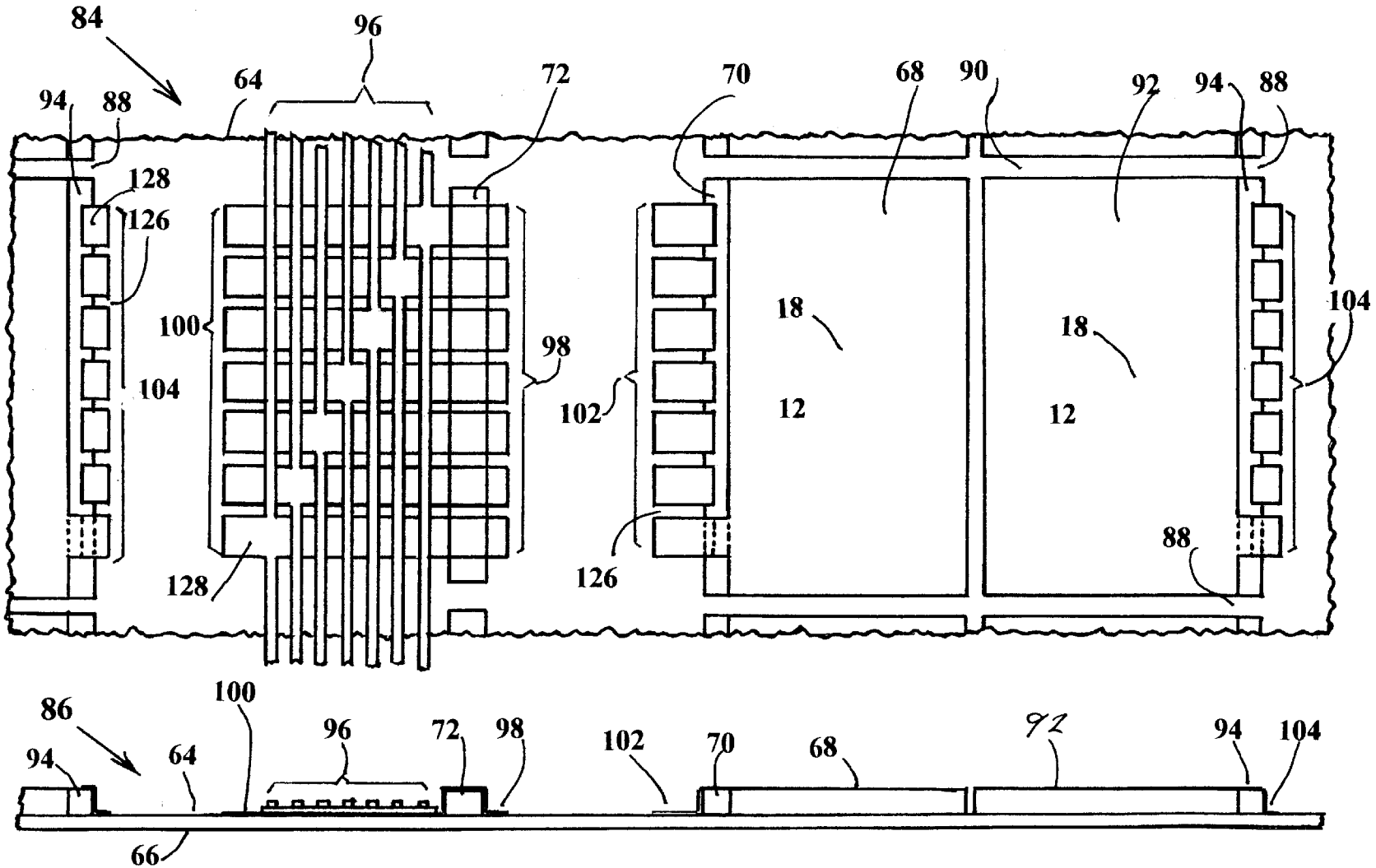
FIG. 6 illustrates coating patterns on a pellicle for application in the preferred embodiment of the invention.

FIG. 6 shows plan 84 and elevation 86 views of the membrane assembly 64 wherein the thin film coating patterns on the surface of the membrane assembly 64 are illustrated. These coatings are comprised of multi layer patterned conductive and insulating the films. The region shown corresponds to slightly more than the pattern for a pair of pixels associated with adjacent white 16 and black 14 fiber electrodes. This pattern is repeated for each pixel pair in the display device 10. Shown also in FIG. 6 are the two forerunners 68 and 92 for an adjacent pair of membrane stacks 12, along with associated connector/anchors 70 and 94 whereby the stacks 12 are attached to the pellicle assembly 64. Pixel extent along the length of a fiber extends between gaps 88 in the coatings. Orthogonal gaps 90 in the coatings isolate adjacent membrane stacks in the cross-fiber direction. Signal data is transmitted along the direction of the fiber electrodes by the data buss means 96. At each pixel pair location said signal data is distributed to interconnect means 98 and 100 on either side of the data buss means 96. The black fiber electrode assembly 62 includes interconnect means, not shown, by which connectivity will be established with interconnect means 98 and 100. On the black fiber electrode assembly 62, not shown in FIG. 6, are thin film transistor switching means to connect or disconnect signal received via interconnect means 98 and 100 to additional interconnect means 102 and 104 included in the coating pattern on the membrane assembly 64. Interconnect means 102 and 104 supply switched signal voltages individually to membranes 18 of which a membrane stack 12 is comprised. Said interconnect means 102 and 104 are comprised of conductive coatings on the pellicle structure 64 and include a plurality of connection pads 128, isolated by insulated gaps 126. By the means described signal from the plurality of traces which comprise buss means 96 is switched to one or the other or neither of a pixel pair on either side of a black fiber electrode 14. When not actually connected to the data buss means 96 the membranes 18 are electrically isolated whereby voltages set on the membrane capacitances are maintained.

The coating structure illustrated in FIG. 6 is repeated for each pixel pair over the extent of the two-dimensional display device 10, there being a said pixel pair at the pixel spacing interval along each black fiber electrode 14. There is included on the pellicle assembly 64 a plurality of data buss means 96, one of which is associated with each black fiber electrode 14. Typical of a Television type raster scan only a single pixel is addressed at any moment of time. Either field or frame sequential scanning is readily implementable. Illustratively, a pair of TV scan lines would be addressed by switching data onto a selected one of the plurality of buss means 96. Of the two scan lines fed by the said selected buss means 96 one is then selected. Once a scan line is selected the position along the said scan line is next selected by switching the data to a selected membrane stack 12. Membrane stacks 12 not selected are electrically isolated by said switching circuitry that is three-state. All data switching is accomplished by switching means built into the thin film transistor circuitry included on the surface of a black fiber electrode 14.

By the above-described means color imaginal data in a scan pattern can be made available for the display device wherein either a frame or field sequential approach is implementable. Likewise scan interlace can be implemented or not.

Figure 7A:
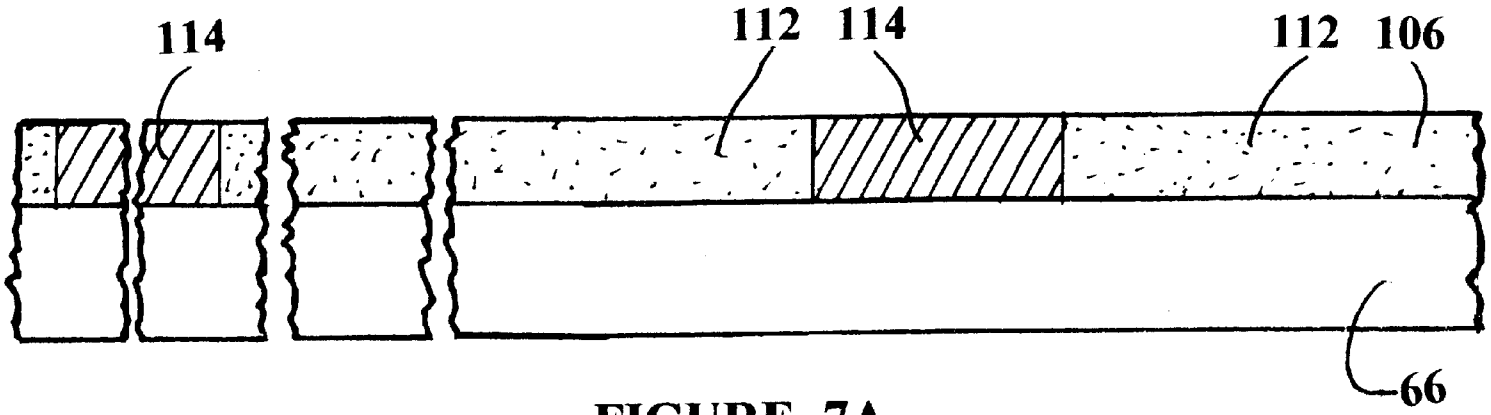
FIGS. 7A, 7B, 7C, 7D, 7E and 7F illustrate process steps in coating the pellicle.
Figure 7B:
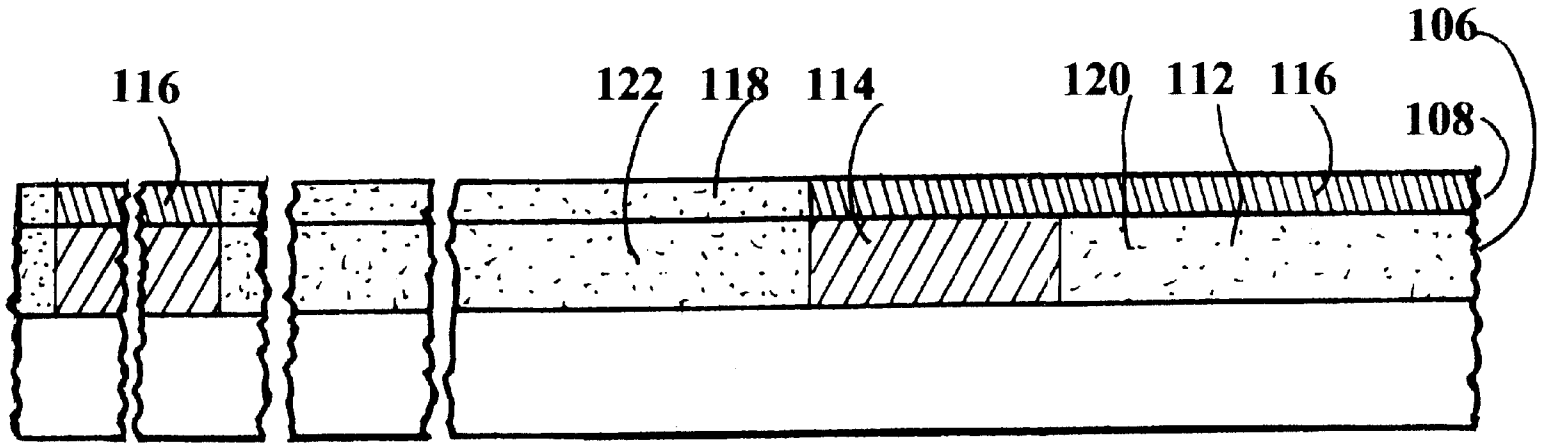
Figure 7C:
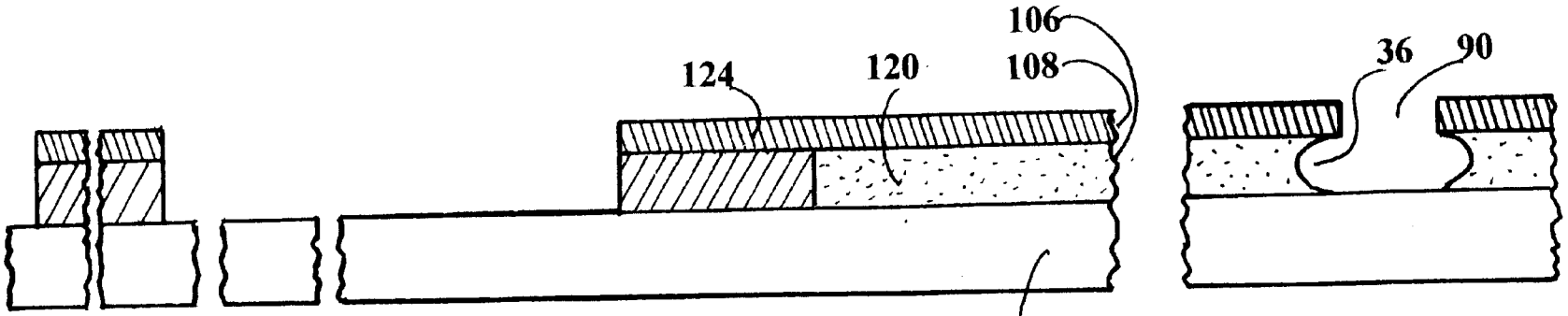
Figure 7D:
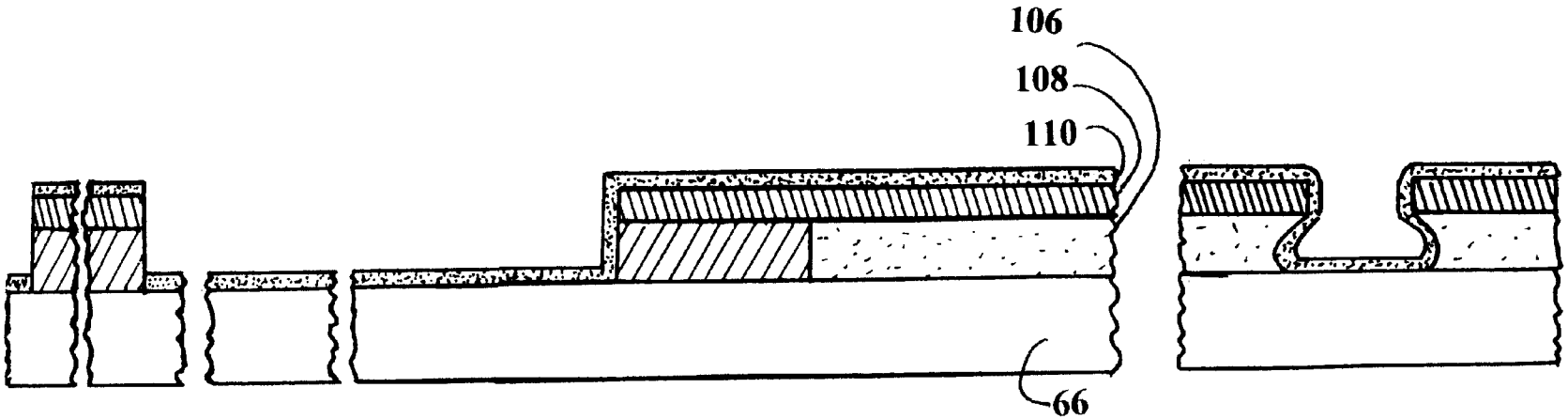
Figure 7E:
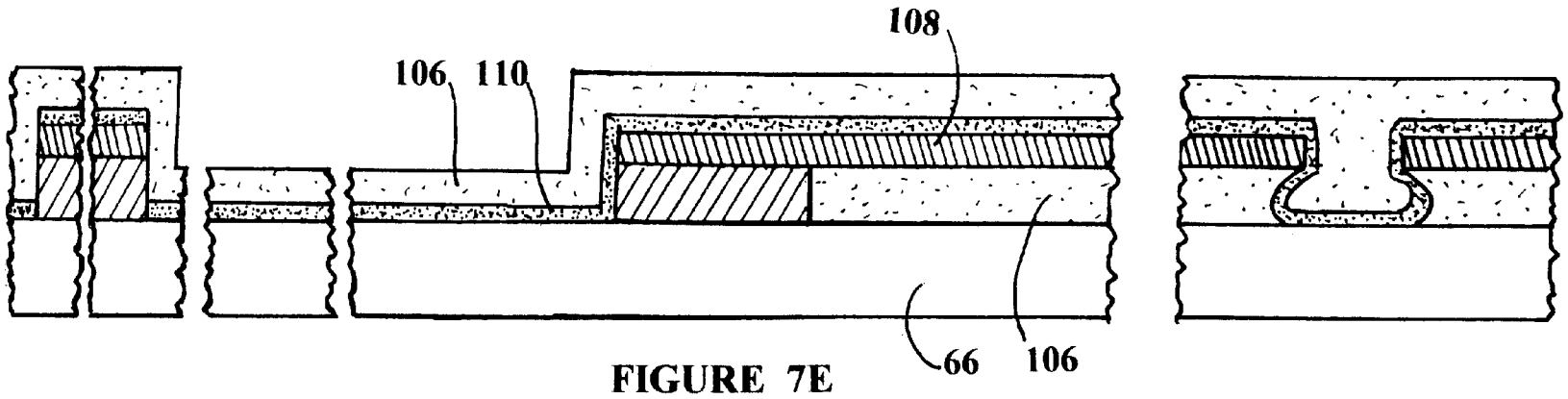
Figure 7F:
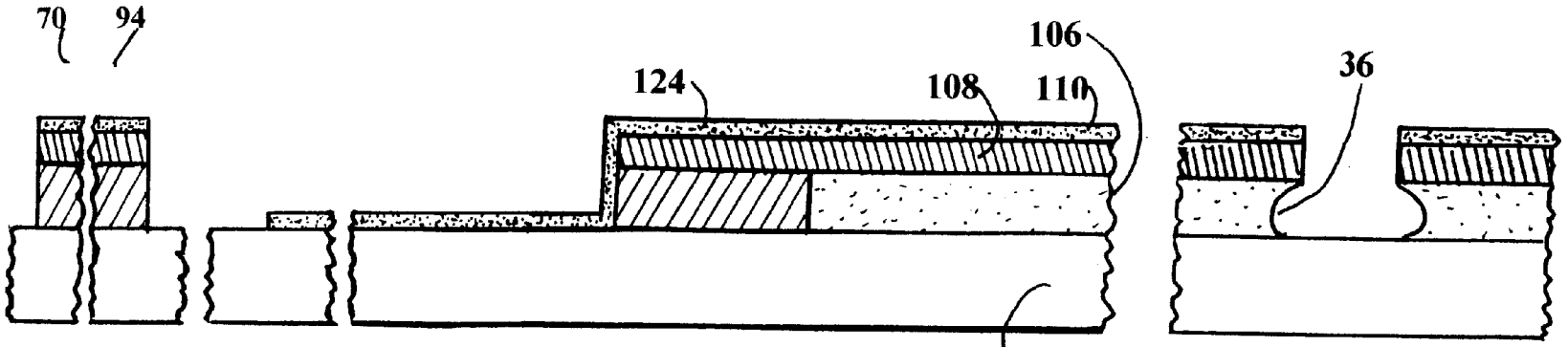

FIGS. 7A, 7B, 7C, 7D, 7E, and 7F illustrate process steps in coating the pellicle substrate 66. Coating materials utilized include positive photoresist 106, negative photoresist to which a colorant has been added 108, and a conductor 110. Multiple layers of these are utilized to fabricate the several thin film structures illustrated in FIG. 6, which includes the plurality of membrane stacks 12 with their individual membranes 18. When initially formed membranes 18 of the membrane stack 12 are attached to one another by a positive photo resist layer 106, portions 112 of which have been rendered soluble by exposure to illumination, and portions 114 of which have not been so exposed and hence remain relative insoluble. As a first step, FIG. 7A, in the fabrication of the multi-layer thin film coating on the pellicle substrate 66 a layer of positive photoresist 106 is applied. This layer is patterned optically utilizing a mask and an illumination source, exposed regions 112 becoming relatively soluble while the unexposed regions 114 remaining insoluble. A colored negative photoresist layer 108 is next applied and patterned by means of a mask and an illumination source, as illustrated in FIG. 7B. In this case the optically exposed regions 116 are modified to become relatively insoluble compared to unexposed regions 118. Selected portions 120 of the underlying positive photoresist layer 106 which have been exposed and which are thereby soluble are protected by the overlying insoluble layer 116. The soluble unprotected regions 122 of the underlying positive photoresist layer 106 along with soluble regions 118 of the overlying negative photoresist layer are next removed chemically, as illustrated in FIG. 7C. In this step a certain amount of undercut 36 is achieved along edges of the gaps 90 and 88, not shown. This undercut will in a later step serve as a forerunner to assist in the etching step wherein the several membranes 18 of a membrane stack 12 are detached from one another. The next thin film coating layer applied 110, illustrated in FIG. 7D, is conductive and this is patterned by means of a positive photoresist layer 106, illustrated in FIG. 7E, along with an appropriate mask and subsequent etching to leave the desired conductive pattern 124, illustrated in FIG. 7F. By repeating the above steps, (FIGS. 7A–7F) all of the thin films required upon the substrate pellicle 66 are generated. These conductive and insulating films comprise the thin film structures illustrated by FIG. 6. The connector/anchors 70 and 94 by which membranes 18 are attached to the pellicle assembly 64 are fabricated as part of the thin film structures on the pellicle assembly 64, as are the connectivity means 98, 100, 102 and 104, and also the connection pads 128, not shown.

Figure 8:
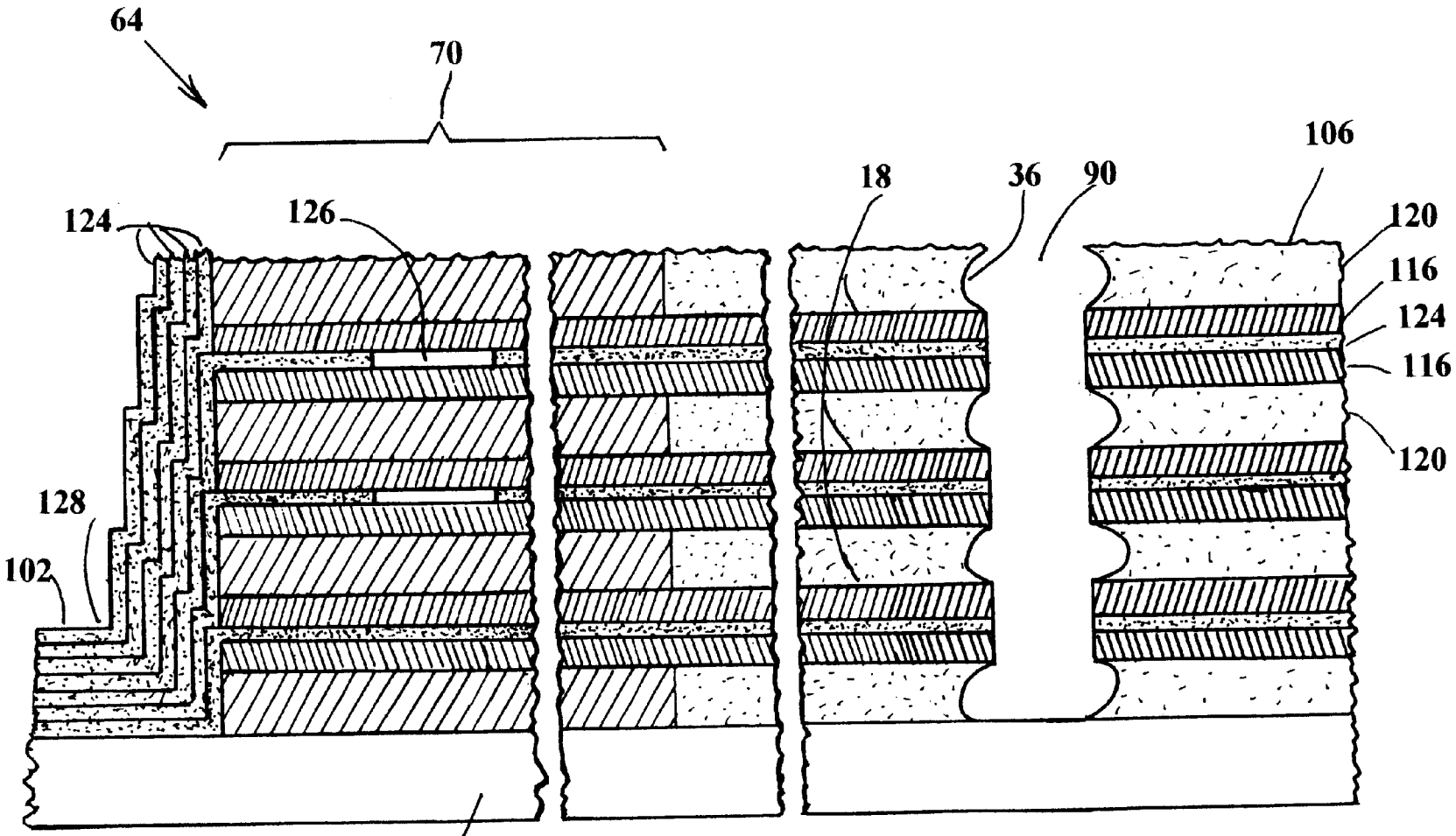
FIG. 8. Illustrates a coating detail of the pellicle

FIG. 8 illustrates portions of a membrane stack 12 resulting form the above-described process for the fabrication of a pellicle assembly. Each membrane 18 of the plurality of membrane stacks 12 is comprised of a conductive layer 124 sandwiched between colored patterned insoluble photoresist layers 116. During fabrication the membranes 18 they are spaced and attached to one another by the soluble but still intact layers 120 of the positive photoresist 106. The membranes 18 will be detached from each other in a later step. As each negative photoresist layer 116 was applied it included a color according to the membrane color scheme established for the color visual display device 10. Interconnect means 98, 100 102 and 104 on the pellicle substrate 66 include conductor build up comprising the several conductive layers 124, as shown by the one conductive means illustrated 102. Each conductive means 98, 100, 102 and 104 is comprised of separate pads 128 to connect a specific signal voltage potential with a specific flexible membrane 18. These pads are defined and separated by nonconductive gap areas 126 fabricated within each of the plurality of conducting layers 124.

Figures 9A, 9B:
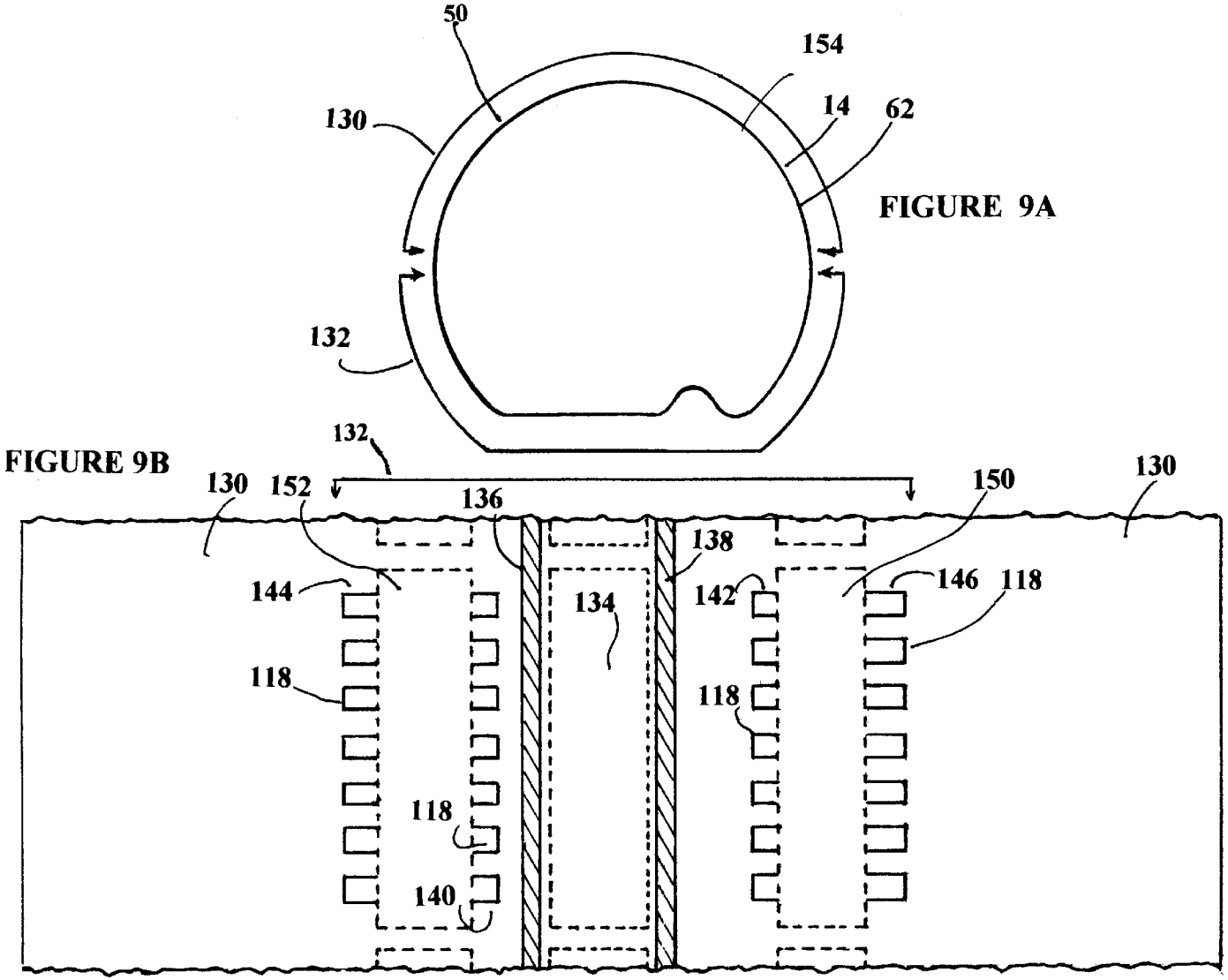
FIGS. 9A and 9B Presents an illustration of a thin film transistor pattern in a silicon coating on a glass fiber.

FIG. 9 is described in conjunction with FIG. 6. FIGS. 9A and 9B illustrate patterned coatings on the Black fiber electrode 14, including silicon thin film transistor switching circuitry. In a preliminary step a glass fiber of desired profile 50 is coated with silicon and the silicon annealed to produce electronic grade silicon and processed to comprise a fiber 154 having electronic circuitry fabricated on its surface. Nearly one half of the fiber electrode circumference 130 is isolated and conductive and runs the entire fiber length. This surface area 130 is held at a fixed voltage and polarity to provide electric forces of either attraction of repulsion in accordance with the data voltage switched onto the membranes 18. The other nearly half of the fiber circumference is partitioned into a plurality of thin film transistor switching circuits 132. FIG. 9A shows the black fiber electrode assembly 62 in cross section while FIG. 9B presents the fiber electrode surface unwrapped wherein the circumference area including the circuitry thereon is shown in a plane. Switching circuitry 132 is fabricated in thin films of silicon, conductor, and insulators and comprises selected electronic circuits. These include a shift register 134, pixel selection leads 136 and 138, data input interconnection means 140 and 142, data output interconnection means 144 and 146 as well as sets of thin film transistor transmission gates 150 and 152 there being one transmission gate for each membrane 18. By means of the shift register 134, fabricated within the silicon coating on the black fiber assembly 62 a switching signal is transmitted sequentially from pixel location to pixel location along the length of the black fiber electrode assembly 62. This switching signal, along with signal on one of the selection leads 136 or 138 selects one set of transmission gates 150 or 152 associated with a specific pixel along the fiber electrode pair 14 and 16. By means of the selected set of transmission gates pixel data supplied by the data buss 96 is connected to the membranes 18 whereby the pixel data are displayed.

In FIG. 9B input interconnection means 140 comprise a set of connector pads 118 which are in one to one electrical contact with mating connection pads 128 which comprise interconnection means 100 included in the circuitry on the pellicle assembly 64. Signal voltages supplied by the data buss means 96 are by these interconnection means connected to one side of transmission gates 152. When said transmission gates are enabled by a selection voltage on lead 136 then the signal voltages are passed by the transmission gates 152 and appear on the output connection means 144. Output connection means 144 comprise a set of connector pads 118 which are in one to one electrical contact with connection pads 128 which comprise the interconnect means 104 on the membrane assembly 64, which are in turn connected electrically to membranes 18. By these means signal voltages are supplied to the corresponding membrane stack 12 and individual membranes 18 of the selected stack will be deflected according to supplied signal voltages, resulting in display of the color datum.

The above described process enables the first of a pair of pixels at a given pixel location along a black fiber assembly 62. The other pixel of the pair is selected by an analogous process, but utilizing interconnection means 98, 142, 146, and 102 along with transmission gate 150 and selection lead 138. Input interconnection means 142 comprise a set of connector pads 118 which are in one to one electrical contact with mating connection pads 128 which comprise interconnection means 98 included in the circuitry on the pellicle assembly 64. Signal voltages supplied by the data buss means 96 are by these interconnection means connected to one side of a set of transmission gates 150. When these transmission gates 150 are enabled as a result of an enabling signal on the selection lead 138 then the signal voltages are passed by the transmission gates 150 and appear on the output connection means 146. The output connection means 146 comprise a set of connector pads 118 which are in one to one electrical contact with mating connection pads 128 which comprise the interconnect means 102 on the membrane assembly 64, which are in turn connected electrically to membranes 18. By these means signal voltages are supplied to the corresponding membrane stack 12 and individual membranes 18 of the selected stack will be deflected according to the supplied signal voltages, resulting in the display of the color datum. The above described process enables the second of the pair of pixels at the given pixel location along any given black fiber assembly 62. Pixel pair selection along a fiber length is made by a signal that propagates the length of the fiber by means of shift-register 134 enabling a single pixel pair at a time.

Figure 10:
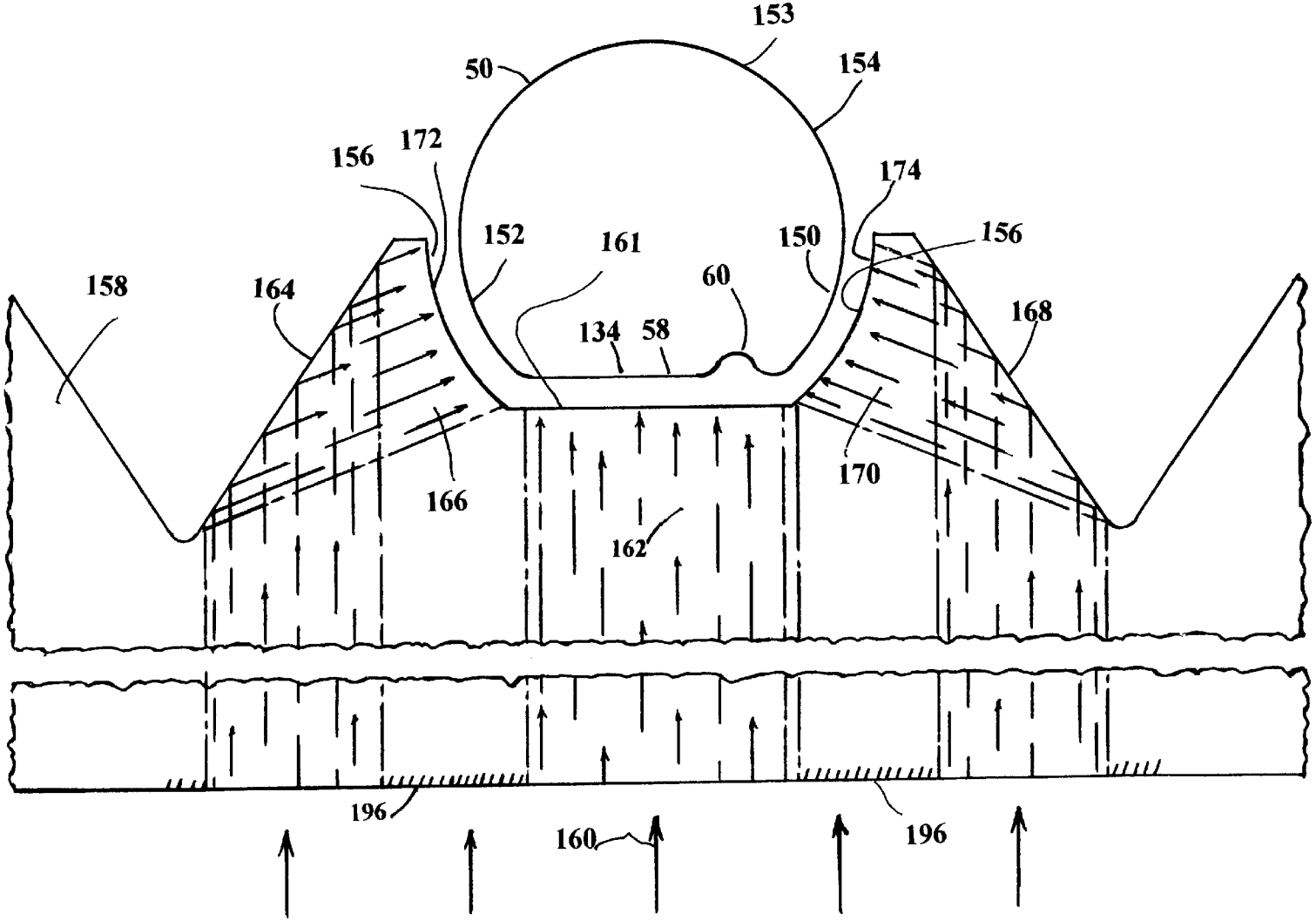
FIG. 10 Illustrates a mask/substrate/illumination combination for exposing photo-resist on a silicon-coated fiber in accordance with a desired thin film transistor pattern.

FIG. 10 illustrates a mask/substrate/illumination combination for exposing photo-resist 153 on a silicon-coated fiber 154 in accordance with a desired thin film transistor pattern. The patterns of masks 172, 161 and 174 fabricated on the surface of a glass prism 158 are transferred as a pattern of exposure into the photo resist 153 on the silicon coated glass fiber 154. FIG. 10 is illustrative of several mask/expose/etch steps which comprise the process by which thin film transistor circuitry is fabricated on said silicon coated glass fiber 154. In the example the fiber is the designated black fiber electrode 14, and the material is fused silica The utilization of fused silica as a substrate for silicon allows process temperatures sufficiently high to anneal deposited amorphous silicon to polysilicon. The superior transistor performance of polysilicon is by this means made available.

FIG. 10 also illustrates proximity focusing wherein surfaces of prism 158 conform closely to corresponding surfaces of fiber electrode 50. Three regions of the thin film circuit on fiber 50 are illustrated. These correspond to shift register 134, the transmission gate set on a first side 152 and the transmission gate set 150 on the second side. Incident illumination flux 160 is partitioned by prism 158 into specific flux beams for each mask section 166, 162 and 170. A resulting first flux beam 162 proceeds directly to mask 161 and then on to the surface 58 of fiber 50 where the shift register 134 is to be fabricated. Flux beams for exposing curved regions 156 of black fiber 50 are isolated by opaque regions 196 and then deviated by reflecting surfaces 164 and 168 on prism 158. The resultant deviated flux beams 166 and 170 then proceed to masks sections 172 and 174 and exit the prism via faces 172 and 174 which are conformal to the curved surfaces of the black fiber 50. The transmission gates 152 and 150 are fabricated in the silicon coating on curved portions 156 of black fiber 50. Fabrication of thin film transistor circuitry within the silicon 154 on the surface of fuse silica fiber 50 proceeds using the various steps of well-established techniques. The inventive approach described, however, produces silicon electronics on a curved surface rather than flat.

Figure 11:
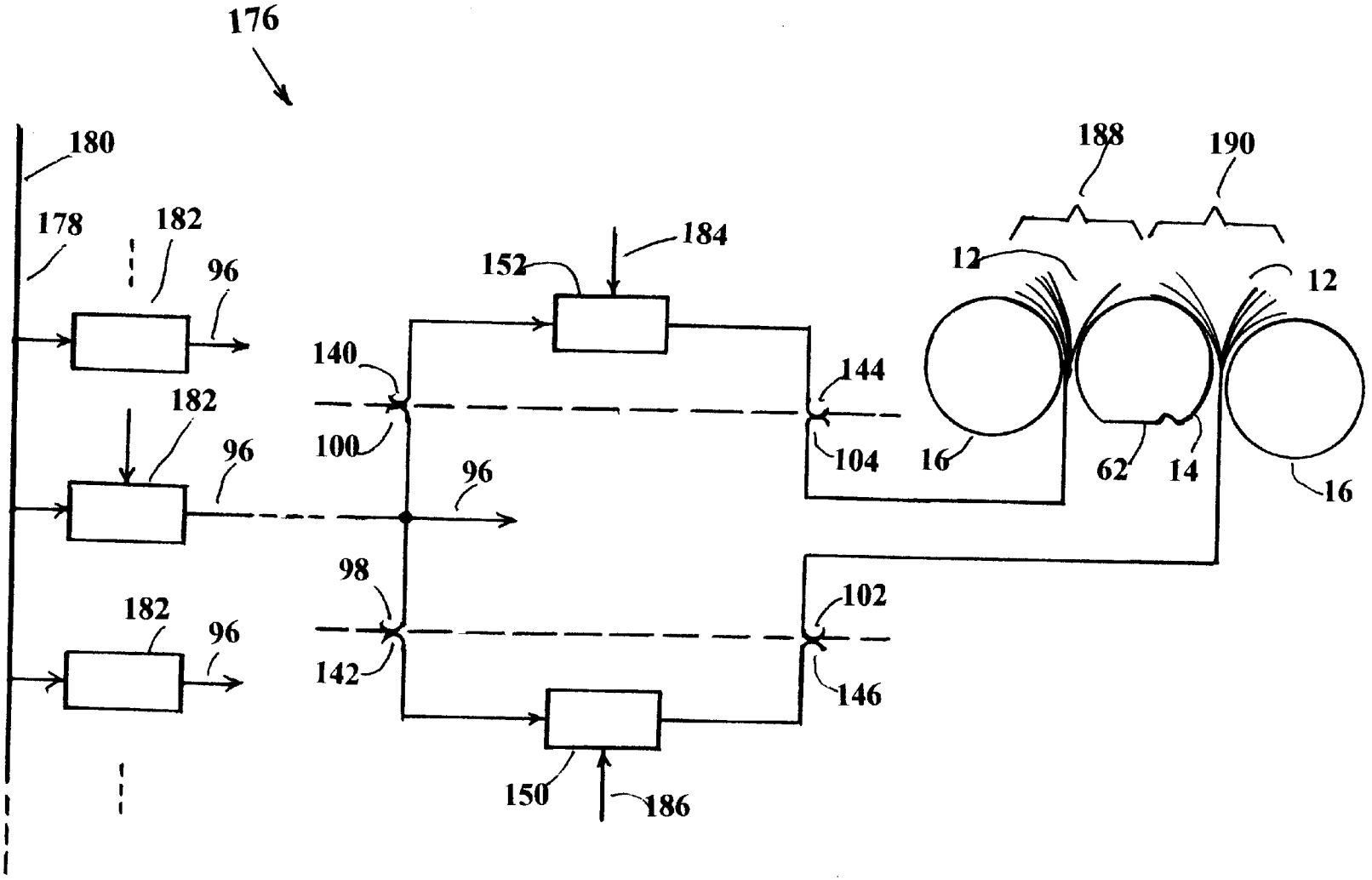
FIG. 11 illustrates electronic circuitry that provides an input data stream to individual pixels of the display device in accordance with a predetermined scan pattern.

FIG. 11 illustrates electronic circuitry 176 that switches an input data stream 178 to individual pixels of the display device in accordance with a scan pattern. FIG. 11 is best understood in conjunction with FIGS. 6 and 9B. Data stream 178 representing an image to be displayed by the display device 10 is supplied from a source, not shown, on data buss means 180. The data stream 178 is comprised of a plurality of voltages on as many conductive traces. Data stream 178 is connected sequentially to one of a plurality of data buss means 96 by sequentially enabling one of a plurality of data transmission gate means 182. Enablement of gate means 182 is by means of timing and control circuitry, well known in the state of the art but not shown. When enabled, a specific transmission gate 182 further connects the data stream 178 to one of the plurality of data buss means 96 comprised of thin film circuitry coatings on the membrane assembly 64. Data buss 96 is parallel to fibers 14 and 16 and extends the full extent of the display device 10. Connection of the data stream 178 sequentially to the plurality of data buss means 96 comprises the vertical feature of a raster scan.

Scan horizontal function is accomplished by further connecting data stream 178 to individual pixels along the selected pair of scan lines by means of transmission gates 152 or 150 comprised of thin film transistor circuitry fabricated in the silicon coated black fiber assembly 62. At each pixel location along a given data buss means 96, either pixel of a pair, 188 or 190, are selected by means including voltages on selection leads 136 and 138, not shown. Horizontal scanning is facilitated by means of a signal that propagates along shift-register 134 that in conjunction with a voltage on either selection lead 136 or 138 produces enabling signal on either lead 184 or 186. By this means data stream 178 transits one of the pair of transmission gates 152 or 150 and is supplied to one of the pair of pixels 188 or 190.

Data path to a first pixel 188 comprises, in sequence, data buss means 180, a selected transmission gate 182, data buss means 96, and interconnection means 100 on membrane assembly 64: interconnection means 140 transmission gates 152, and interconnection means 144 on black fiber 50: interconnection means 104 and membranes 18 on membrane assembly 64.

Data path to the second pixel 190 comprises, in sequence, data buss means 180, a selected transmission gate 182, data buss means 96, and interconnection means 98 on membrane assembly 64: interconnection means 142 transmission gates 150, and interconnection means 146 on black fiber 50: interconnection means 102 and membranes 18 on membrane assembly 64.

In the preferred embodiment the surface each of the plurality of white fibers 16 comprises an electrode and is at one fixed polarity. Approximately half of the circumference of each black fiber assembly 14 and 62 comprises an electrode at fixed polarity opposite the fixed polarity of the white electrode 16. In the illustrative example for an eight-color palette (KRGBCMYW) seven membranes 18 are required in a membrane stack 12. There are accordingly seven conductive leads in the data buss means, both 180 and 96. Each transmission gate means, 182, 152 and 150 comprises seven separate thin film transistor tri-level transmission gates. When enabled they transmit signal of either voltage. When not enabled transmission gates means, 182, 152, and 150 are non-conductive providing electrical isolation of non-selected membranes 18. Electric charge supplied to the membranes 18 will be retained in circuit capacitances. Auxiliary sample-and-hold electronics can enable extended duration retention of charge retention. By this means data displayed by the pixels will be retained once established. In an optional preferred embodiment the switching means 150 and 152 comprise means to actively maintain the charges on the membranes over extended periods and further comprise means to sense the charge polarities enabling the stored image to be recovered as a data stream on buss means 96 and 180.

Figure 12:
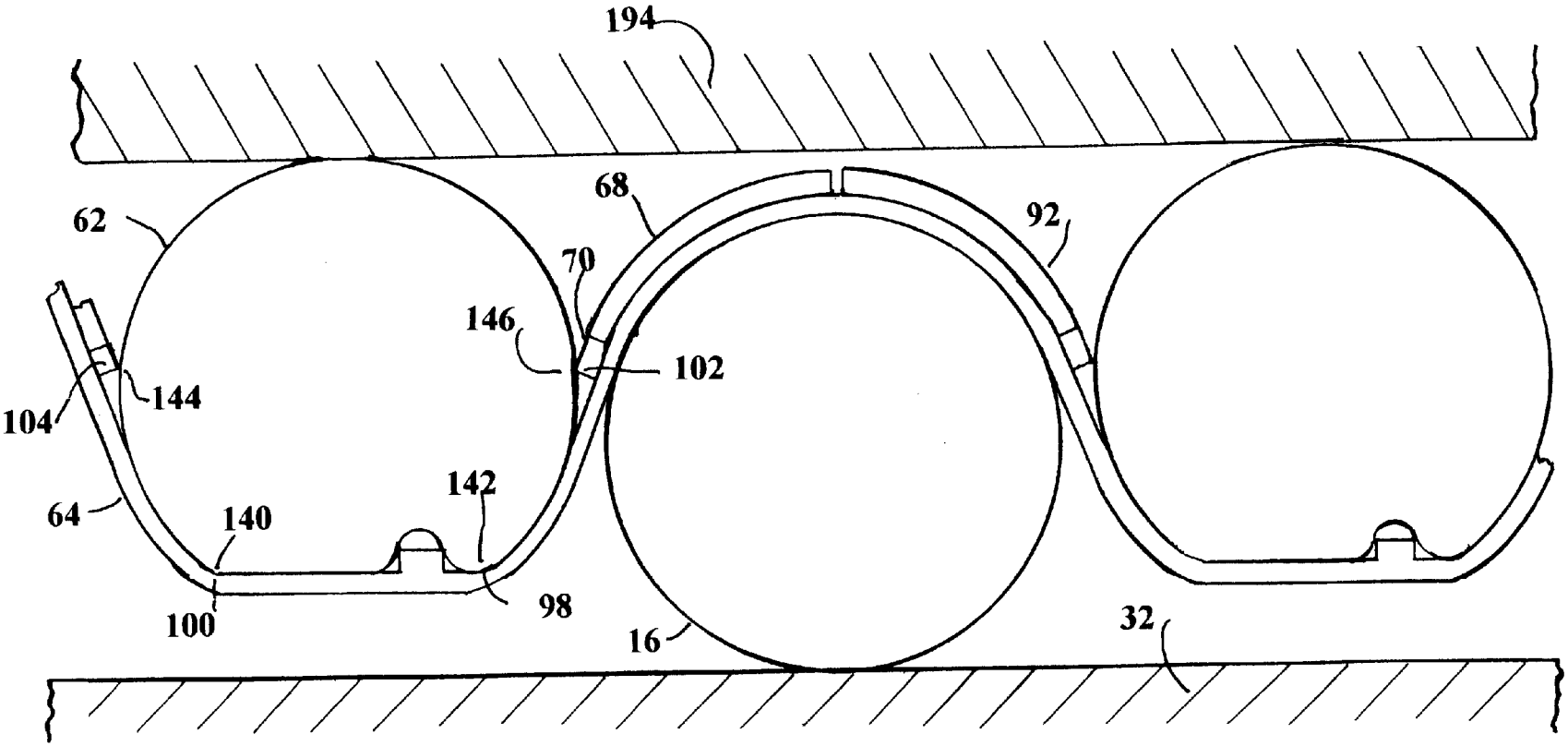
FIG. 12 presents an additional intermediate step in the fabrication of the preferred embodiment of a display device made in accordance with the invention.

FIG. 12 presents an additional intermediate step in the production of the preferred embodiment of a display device made in accordance with the invention and is best described in conjunction with FIGS. 4 and 6. As shown in FIG. 12 membrane assembly 64 has been folded between a of lower enclosure 32 and a tool 194. By this means white fibers 16 are brought to be nearly coplanar with black fiber assemblies 62. As a result of this fold electrical connections are made between connectivity means 98, 100, 102 and 104 on the membrane assembly and mating connectivity means 140, 142, 144 and 146 on the black fiber assemble 62. Fusible compliant conductive bumps on the interconnection pads 118 on the black fiber electrode 62 and pads 128 of the pellicle assembly 64 are appropriate and will provide a degree of mating flexibility. Fusing the said conductive bumps facilitates a permanent bond between pellicle assembly 64 and the black fiber electrode 62. At this stage of fabrication the membranes 18 of each membrane stack need not as yet been detached from one another but are still held together by the soluble photoresist spacers 120. These are identified in the figure as forerunners 68 and 92 of the membrane stack 12.

Figure 13:
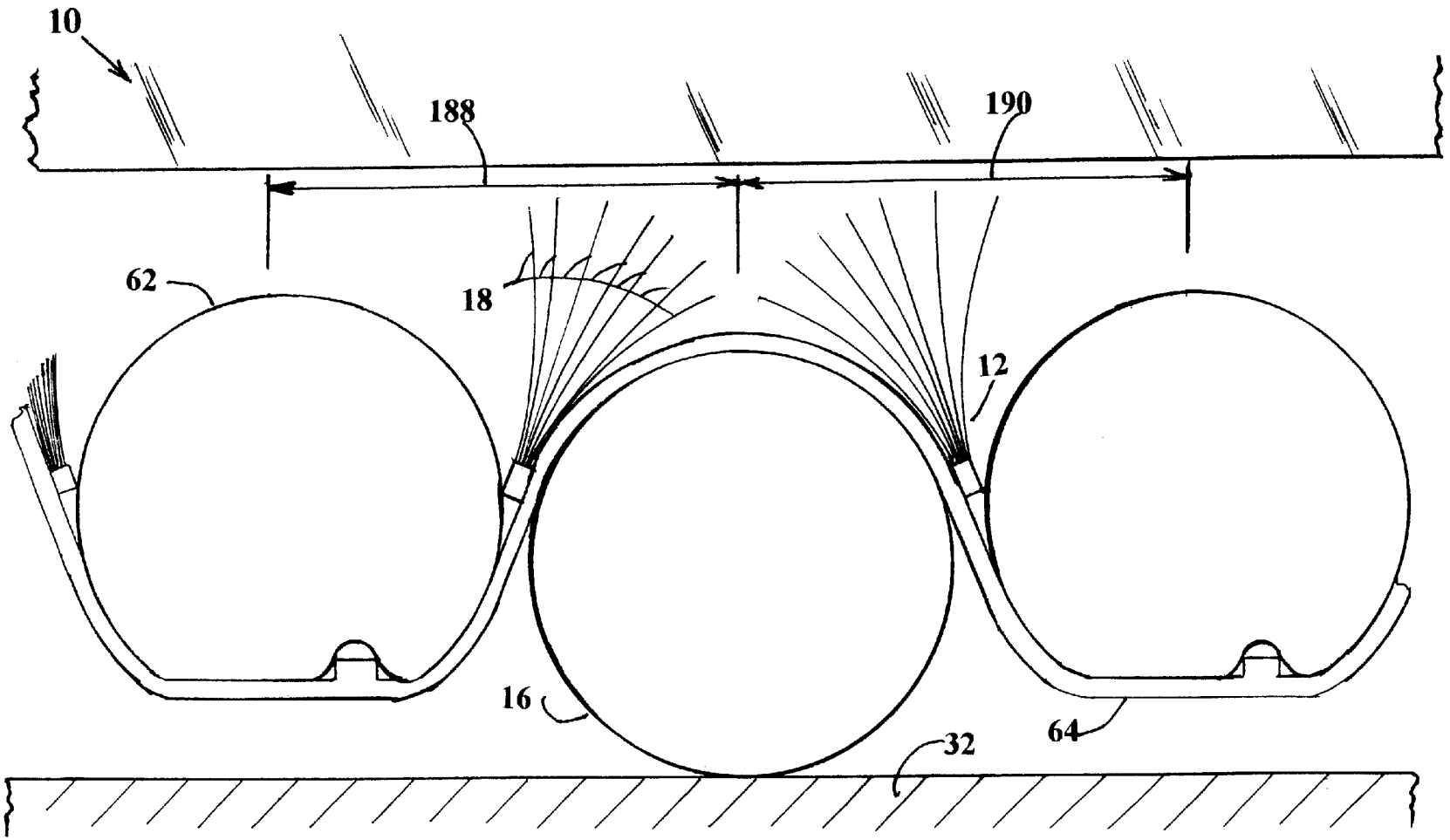
FIG. 13 presents a cross-section view of components of a display device fabricated according to the preferred embodiment of the present invention showing membranes of the membrane stacks having been separated.

FIG. 13 shows a cross section of the preferred embodiment of a wrap around membrane color display device. Individual membranes 18 of membrane stacks 12 have been detached from one another by dissolving the soluble photoresist 120 between the membranes 18. During the dissolving process membranes detachment is optionally aided by cyclical electric forces applied by means of the electronics and the connectivity means. The figure shows the transparent top cover 34 as having been added, along with the bottom closure 32. Sealing around the perimeter of the display device, along with connectivity to sources of electric power, synchronization and signal completes the fabrication. Both the sealing and the connectivity technologies are well known.

While the invention has been described in conjunction with specific embodiments, it is evident to those skilled in the art that many alternatives, modifications, and variations will be apparent in light of the foregoing description. Accordingly the invention is intended to embrace all such alternatives, modifications and variations as fall within the spirit and scope of the appended claims.

What is claimed is:

1. A color display device comprising:

a two dimensional array of color pixels comprising at least one row and at least one column of color pixels, wherein each pixel is comprised of a stack of a plurality of colored flexible membranes juxtapositioned and anchored between adjacent colored fiber electrodes, and wherein said plurality of membranes are comprised of insulated conducting films, said plurality of membranes of any stack are attracted to or repelled from each other and said adjacent colored fiber electrodes in accordance with voltages supplied to said plurality of membranes and said adjacent fiber electrodes, the surfaces of said adjacent fiber electrodes and/or surfaces of said plurality of membranes having common voltage polarity are separated, and when the membranes on either side of said separation are charged with alternating voltage polarities they are attracted to each other and to the nearest said adjacent fiber electrodes such that said separated surfaces are visible to an observer and produce one color pixel.

2. The color display device of claim 1 wherein available pixel colors comprise at least three colors and are selected from a color set comprising at least: Black, Red, Green, Blue, Cyan, Magenta, Yellow and White (KRGBCMYW) wherein each pixel of which said display is comprised can optionally and independently be set to any of the available colors.

3. The color display device of claim 2 wherein said fiber electrodes are comprised of at least one fiber pair comprising a first and a second fiber electrode wherein each said first fiber electrode is of a first color and is charged to a voltage polarity and each said second fiber electrode is of a second color and is charged to a voltage polarity and wherein surfaces of said adjacent fiber electrodes and/or said plurality of membranes which face each other are of common color whereby when facing surfaces are separated by electrical forces the common color of the separated surfaces is visible to an observer and produces a color pixel.

4. The color display device of claim 3 further comprising connectivity means whereby a pattern of voltages representative of a data stream is connected to said plurality of membranes in accordance with a scan pattern whereby the plurality of membranes of each said stack of membranes are supplied with a voltage pattern whereby pixels of said display device produce a representation of the image represented by said data stream.

5. The color display of claim 4 wherein means are provided whereby signal voltages connected to any of said membranes of any of said plurality of membrane stacks are optionally of one or the other polarity whereby membrane capacitances are charged and positions of said membranes established while said signal voltages are connected and whereby membrane positions and electric charge on membrane capacitances are retained when said membranes are electrically isolated.

6. The color display device of claim 5 further comprising perimeter and bottom closures along with a transparent top closure and means for connection to power, scan signal and data from an external source whereby imaginal information from the external source is displayable.

7. The color display device of claim 6 wherein said display device comprises:

a. a pellicle assembly comprised of (1) said membrane stacks, (2) conductive traces and, (3) means to mate mechanically and electrically with and align to said at least one fiber electrode pair and, b. a first fiber electrode of said at least one fiber electrode pair of a first color and comprised of a silicon coated glass fiber patterned and processed to constitute at least: (1) thin film transistor means, (2) a surface electrode whereby electrical forces of attraction or repulsion are generated and, (3) means to mate mechanically and electrically with and align to said pellicle assembly and, c. a second fiber electrode of said at least one fiber electrode pair of a second color and which is comprised of a conductively coated glass fiber and, d. wherein each said first fiber electrode mates electrically and mechanical to one side of said pellicle assembly and said second fiber electrode mates mechanically to the other side of said membrane assembly whereby said pellicle assembly wends under each first fiber and over each second fiber and whereby electrical connectivity is established between said conductive traces on said membrane assembly and said thin film transistor means on each first fiber electrode and, said plurality of membranes and, wherein said membranes of said membrane stacks are anchored along an edge between said first and second fiber electrodes and are free to flex under the influence of forces generated by voltages transmitted over said connectivity means whereby surfaces of common color will be separated and produce visible color pixels.

8. The color display device of claim 7 wherein said thin film transistor means further comprises means to sense charge retained by said individual pixel capacitances whereby the image displayed by said color display device is made available as a data stream.

9. The color display device of claim 7 wherein one fiber electrode of said electrode pair is black and the other fiber electrode is white and said membrane stacks are comprised of seven membranes whereby a color gamut of KRGBCMYW is implemented.

10. The color display device of claim 7 wherein one fiber electrode of said electrode pair is black and the other fiber electrode is white and said membrane stacks are comprised of four membranes whereby a color gamut of KRGBW is implemented.

11. The color display device of claim 7 wherein one fiber electrode of said electrode pair is black and the other fiber electrode is white and wherein said membrane stacks are comprised of four membranes whereby a color gamut of KCMYW is implemented.

12. The color display device of claim 7 wherein one fiber electrode of said electrode pair is black and the other fiber electrode is white and said membrane stacks are comprised of two membranes whereby a color gamut of black, white and a single color is implemented.

13. The color display device of claim 7 wherein a plurality brightness intensity levels are available for each pixel comprising at least:

a. a maximally light brightness comprised of white and, b. a bright intermediate brightness level comprised of at least one of the four colors: light Gray Cyan, Magenta, and Yellow or combinations of these and, c. a dark intermediate brightness comprised of at least one the four colors: dark Gray, Red, Green, and Blue or combinations of these and, d. a maximally dark brightness comprised of black.

14. The color display device of claim 7 wherein said means provided to mate mechanically and electrically are replicated at intervals over the display device and comprised of flats, grooves, bumps, ridges and/or notches whereby said pellicle assembly and at least one fiber of said fiber electrode pair are mated, aligned and integrated such that the necessary and sufficient six degree of freedom constraints are established for groups of at least one pixel and wherein electrical connectivity is established between said fiber electrodes and said pellicle assembly.

15. The color display device of claim 1 wherein available pixel colors comprise at least two colors selected from a color set comprising at least: Black, dark Gray ($g_1$), Red, Green, Blue, Cyan, Magenta, Yellow, light Gray ($g_2$) and White ($Kg_1RGBCMYg_2W$) and wherein each pixel of which said display is comprised can optionally and independently be set to any of the available colors.

* * * * *